US006012957A

United States Patent [19]

Cyrus et al.

[11] Patent Number: 6,012,957

[45] Date of Patent: Jan. 11, 2000

[54] SINGLE BEAM OPTOELECTRIC REMOTE CONTROL APPARATUS FOR CONTROL OF TOYS

[75] Inventors: Peter Cyrus, Seattle, Wash.; Leo M. Fernekes, New York; Stefan Rublowsky, Brooklyn, both of N.Y.

[73] Assignee: Parvia Corporation, Seattle, Wash.

[21] Appl. No.: 08/958,501

[22] Filed: Oct. 27, 1997

[51] Int. Cl.[7] ..... A63H 30/00; A63H 18/00

[52] U.S. Cl. ..... 441/175; 446/446

[58] Field of Search ..... 446/175, 456, 446/455, 454, 444, 446, 468, 460; 180/167, 168; 701/117; 901/1

[56] References Cited

U.S. PATENT DOCUMENTS

D. 304,484 11/1989 Knudsen .
D. 306,188 2/1990 Tapdrup et al. .
D. 306,190 2/1990 Poulsen .
D. 307,775 5/1990 Pedersen .
D. 366,914 2/1996 Frederiksen .
D. 367,896 3/1996 Knudsen .
D. 367,897 3/1996 Schmidt et al. .
1,393,163 10/1921 Rasely .
2,106,424 1/1938 Einfalt ..... 446/444 X
2,674,813 4/1954 Hutchinson .
2,871,619 2/1959 Walters .
2,942,354 6/1960 Grain .
3,005,282 10/1961 Christiansen .
3,025,626 3/1962 Schumacher .
3,034,254 5/1962 Christiansen .
3,162,973 12/1964 Christiansen .
3,234,683 2/1966 Christiansen .
3,236,004 2/1966 Christiansen .
3,242,610 3/1966 Christiansen .
3,284,946 11/1966 Christiansen .
3,352,054 11/1967 Glass et al. .
3,461,601 8/1969 Kristiansen .
3,475,851 11/1969 Christiansen .
3,597,858 8/1971 Ogsbury .
3,597,875 8/1971 Christiansen .
3,667,153 6/1972 Christiansen .
3,742,620 7/1973 Knoll .
3,981,506 9/1976 Daniel et al. .
4,028,844 6/1977 Dideriksen et al. .
4,176,493 12/1979 Dideriksen .
4,185,410 1/1980 Kristiansen .
4,203,248 5/1980 Tapdrup .
4,205,482 6/1980 Christiansen et al. .
4,214,403 7/1980 Knudsen .
4,245,400 1/1981 Johnson .
4,403,733 9/1983 Bach et al. .
4,430,063 2/1984 Bach et al. .
4,430,826 2/1984 Ryaa .
4,461,116 7/1984 Bach .
4,556,393 12/1985 Bolli .
4,563,162 1/1986 Ishimoto ..... 446/175
4,579,041 4/1986 Organ et al. .
4,589,702 5/1986 Bach et al. .
4,685,884 8/1987 Rohan .
4,715,832 12/1987 Bach .
4,726,515 2/1988 Bolli et al. .
4,743,202 5/1988 Bach .
4,828,525 5/1989 Okano ..... 446/175
4,846,750 7/1989 Tapdrup .
4,854,742 8/1989 Bach .
4,861,306 8/1989 Bolli et al. .
4,865,575 9/1989 Rosenthal ..... 446/175
4,874,176 10/1989 Auerbach .
4,883,440 11/1989 Bolli .
4,894,040 1/1990 Bach et al. .
4,897,066 1/1990 Tapdrup et al. .
4,937,181 6/1990 Rogers .
4,938,483 7/1990 Yavetz ..... 446/175 X
4,978,301 12/1990 Dodge .
4,988,322 1/1991 Knudsen .
4,988,324 1/1991 Ryaa et al. .
4,992,069 2/1991 Bolli et al. .
4,998,903 3/1991 Bolli et al. .
5,011,411 4/1991 Loewy .
5,015,210 5/1991 Dideriksen .
5,042,972 8/1991 Bach et al. .
5,049,078 9/1991 Thomsen .
5,049,104 9/1991 Olsen .
5,071,384 12/1991 Poulsen .
5,087,001 2/1992 Bolli et al. .
5,094,643 3/1992 Bolli et al. .
5,112,263 5/1992 Penillard et al. .
5,251,900 10/1993 Gallant .
5,304,086 4/1994 Bolli et al. .
5,322,466 6/1994 Bolli et al. .

| | | | |
|---|---|---|---|
| 5,326,267 | 7/1994 | Brokaw . | |
| 5,348,478 | 9/1994 | Bradshaw . | |
| 5,349,734 | 9/1994 | Poulsen et al. . | |
| 5,360,364 | 11/1994 | Poulsen et al. . | |
| 5,373,791 | 12/1994 | Bach et al. . | |
| 5,378,191 | 1/1995 | Ryaa . | |
| 5,380,232 | 1/1995 | Berggreen et al. . | |
| 5,387,148 | 2/1995 | Dideriksen et al. . | |
| 5,417,603 | 5/1995 | De Chazal . | |
| 5,427,530 | 6/1995 | Taggart . | |
| 5,427,558 | 6/1995 | Knudsen et al. . | |
| 5,452,901 | 9/1995 | Nakada et al. | 446/175 X |
| 5,494,471 | 2/1996 | Ryaa et al. . | |
| 5,580,295 | 12/1996 | Ruzskai et al. . | |
| 5,596,181 | 1/1997 | Bach et al. . | |
| 5,643,038 | 7/1997 | Olsen et al. . | |
| 5,645,463 | 7/1997 | Olsen . | |

FOREIGN PATENT DOCUMENTS

| | | | |
|---|---|---|---|
| 404048384 | 1/1992 | Japan | 446/175 |
| 2235137 | 2/1991 | United Kingdom | 446/456 |

*Primary Examiner*—D Neal Muir
*Attorney, Agent, or Firm*—Christensen O'Connor Johnson & Kindness PLLC

[57] ABSTRACT

The present invention is an apparatus for control of toys. Preferably, the present invention is a remote control apparatus for guiding toy vehicles on a roadway. Most preferably, a remote control hand unit is employed that is most preferably optoelectric. The hand unit includes a plurality of direction keys that transmit signals from the hand unit based on their electronic interconnection with a directional light transmitter in the hand unit. The hand unit transmits directional commands to control movement of a toy vehicle through the intersection of a roadway. These control commands are directionally transmitted via a modulated signal that is received by a sensor adjacent the roadway.

13 Claims, 19 Drawing Sheets

SINGLE BEAM OPTOELECTRIC REMOTE CONTROL APPARATUS FOR CONTROL OF TOYS

FIELD OF THE INVENTION

The invention relates to the control of toys and, more particularly, optoelectric remote controlled control thereof.

BACKGROUND OF THE INVENTION

U.S. Pat. No. 1,084,370 discloses an educational apparatus having a transparent sheet of glass laid over a map or other illustration sheet that is employed as a surface on which small moveable figures are guided by the movement of a magnet situated below the illustration sheet. Each figure, with its appropriate index word, figure or image is intended to arrive at an appropriate destination on the top of the sheet and to be left there temporarily.

U.S. Pat. No. 2,036,076 discloses a toy or game in which a miniature setting includes inanimate objects placeable in a multitude of orientations on a game board and also includes animate objects having magnets on their bottom portions. A magnet under the game board is employed to invisibly cause the movement of any of the selected animate objects relative to the inanimate objects.

U.S. Pat. No. 2,637,140 teaches a toy vehicular system in which magnetic vehicles travel over a toy landscape as they follow the movement of ferromagnetic pellets through an endless nonmagnetic tube containing a viscous liquid such as carbon tetrachloride. The magnetic attraction between the vehicles and ferromagnetic pellets carried by the circulating liquid is sufficient to pull the vehicles along the path defined by the tube or channel beneath the playing surface.

U.S. Pat. No. 3,045,393 teaches a device with magnetically moved pieces. Game pieces are magnetically moved on a board by reciprocation under the board of a control slide carrying magnetic areas or elements longitudinally spaced apart in the general direction of the motion path. The surface pieces advance step-by-step in one direction as a result of the back and forth reciprocation of the underlying control slide.

U.S. Pat. No. 4,990,117 discloses a magnetic force-guided traveling toy wherein a toy vehicle travels on the surface of a board, following a path of magnetically attracted material. The toy vehicle has a single drive wheel located centrally on the bottom of the vehicle's body. The center of the gravity of the vehicle resides substantially over the single drive wheel so that the vehicle is balanced. A magnet located on the front of the vehicle is attracted to the magnetic path on the travel board. The magnetic attraction directly steers the vehicle around the central drive wheel along the path.

SUMMARY OF THE INVENTION

The present invention is a control apparatus for guiding toy vehicles on a roadway. Preferably, a remote control hand unit is employed that is most preferably optoelectric. The hand unit includes a plurality of direction keys that transmit command signals from the hand unit based on their electronic interconnection with a directional radiation source in the hand unit. The hand unit thus transmits directional commands to control movement of a toy vehicle through the intersection of a roadway. These control commands are preferably transmitted via a modulated light signal that is received by a light sensor adjacent the roadway. The light signal is focused and is thus received by only one detector at one location on the roadway, although a plurality of detectors at a plurality of locations are present.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
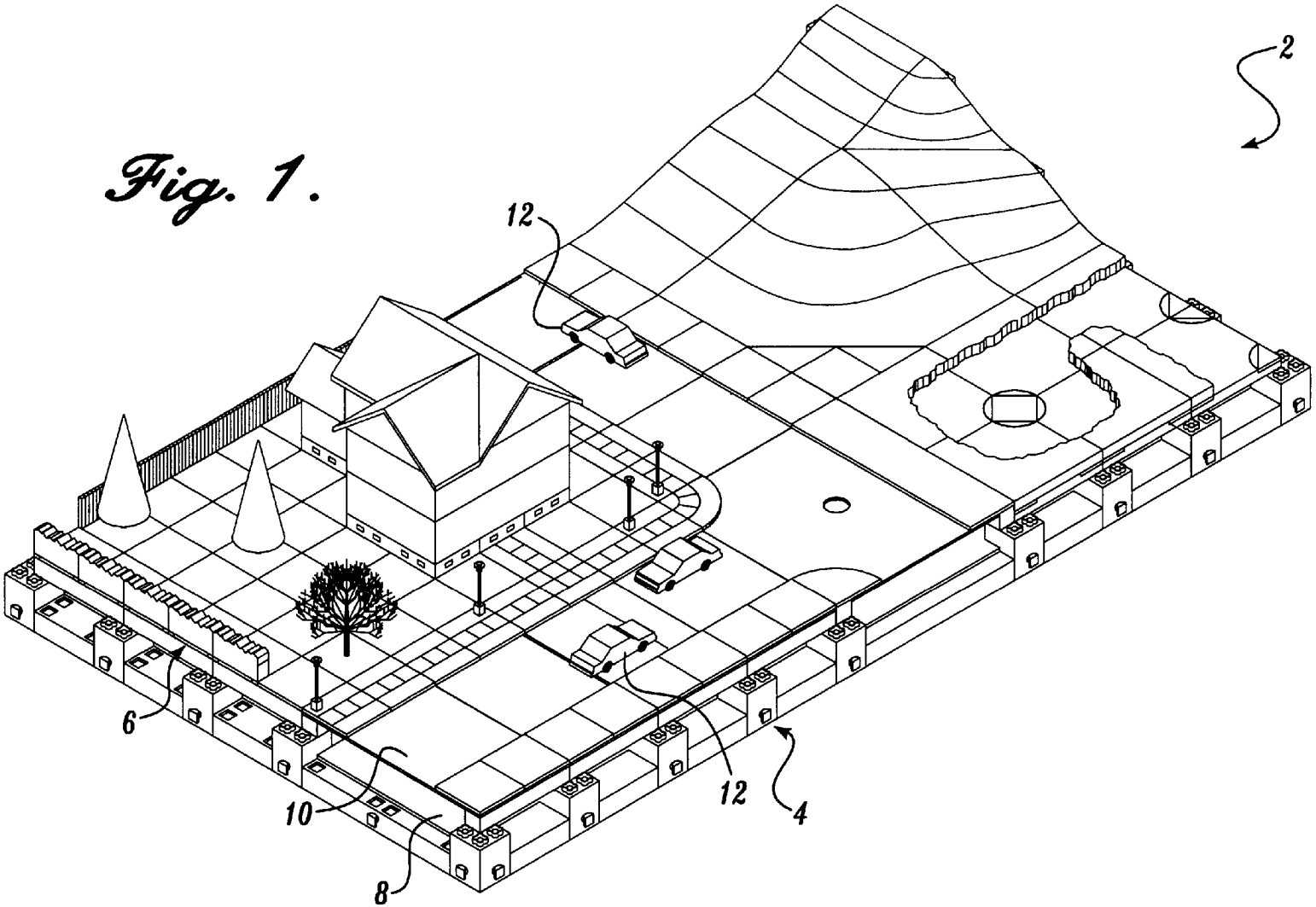
FIG. 1 is an isometric view of a toy building set including the upper roadway and lower roadway of the present invention.
Figure 2:
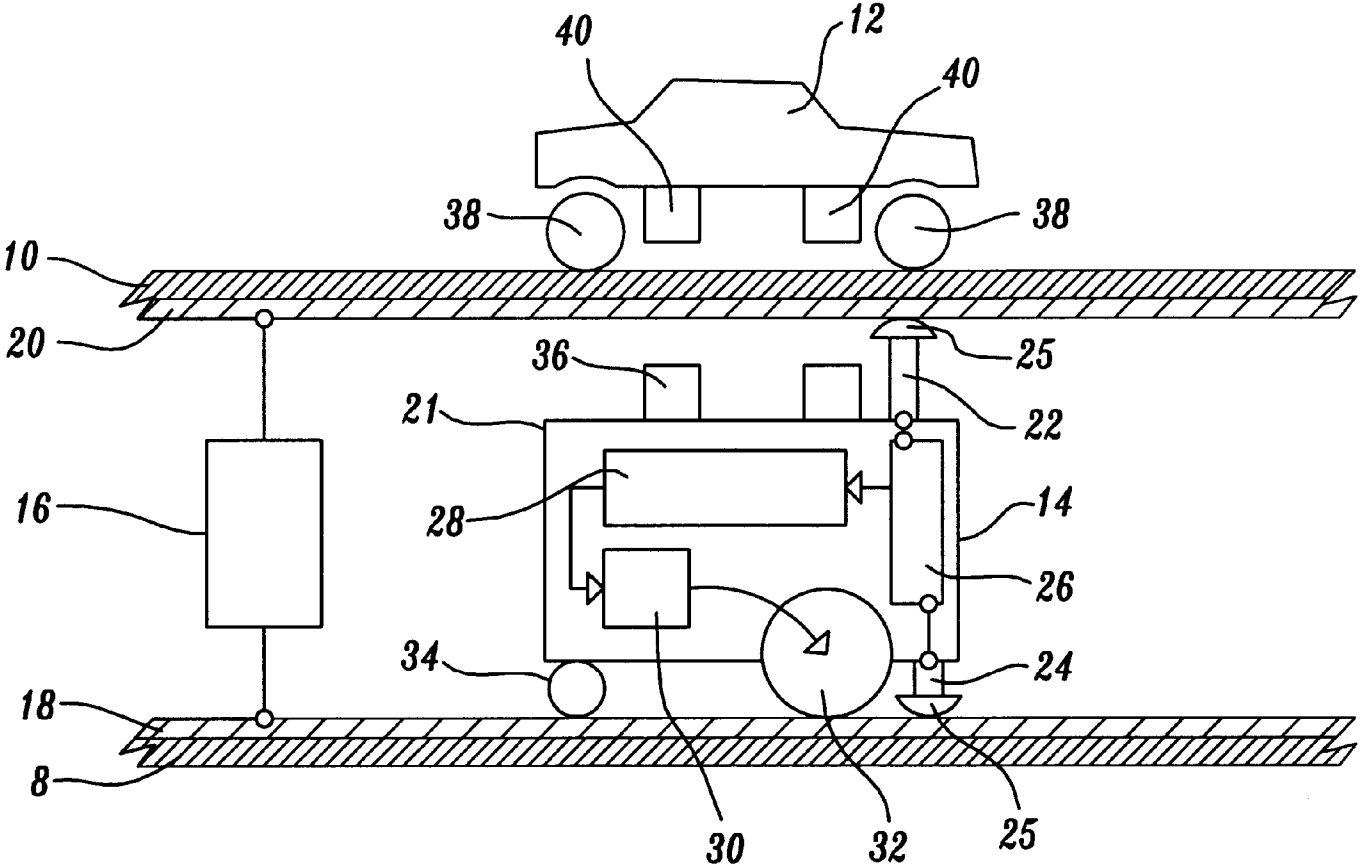
FIG. 2 is a diagrammatic section view of the upper roadway, lower roadway, surface vehicle and powered subsurface vehicle of the present invention.
Figure 3:
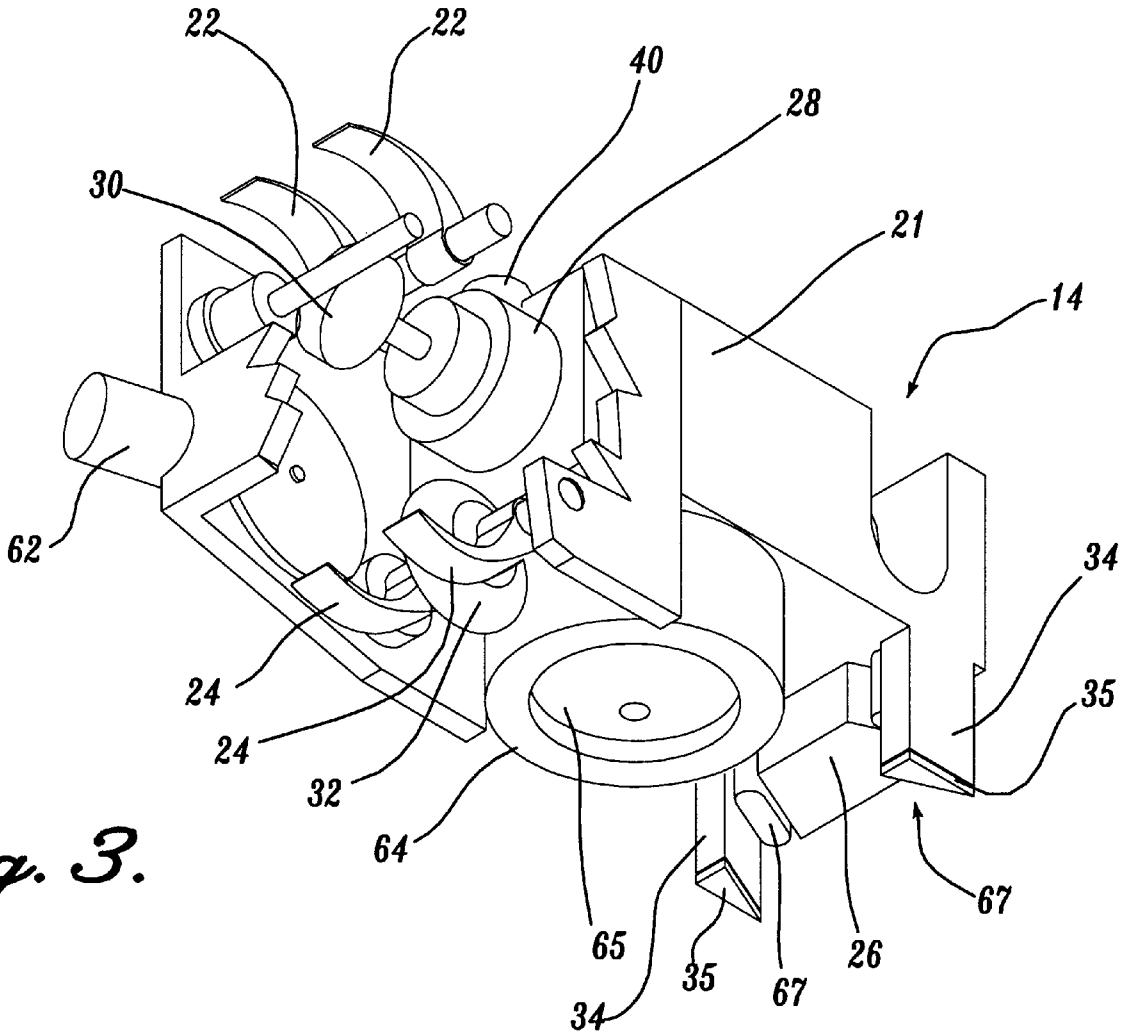
FIG. 3 is a partially exposed isometric view of the powered subsurface vehicle of the present invention.

The present invention is a toy vehicular remote control apparatus as shown and described in FIGS. 1–19. As best shown in FIG. 1, the toy vehicular guidance apparatus of the present invention can be used in a toy building set 2 having a lattice 4 and modular bases 6. More specifically, lattice 4 provides the substructure of toy building set 2 and supports modular bases 6 which are spaced above lattice 4 by a predetermined distance. Lower roadway 8 is also supported by lattice 4, but on a lower portion of lattice 4 at a predetermined distance below modular bases 6. Upper roadway 10 is comprised of some of modular bases 6 that have been specialized in design to provide a smooth traffic bearing surface for movement of surface vehicles 12 thereon. Most preferably, the road pattern of upper roadway 10 and lower roadway 8 are identical so that subsurface vehicles 14, as shown in FIGS. 2 and 3, can travel on lower roadway 8 to guide surface vehicles 12 on upper roadway 10 in a manner further described below. Preferably, the distance between lower roadway 8 secured to lattice 4 and upper roadway 10, also secured to lattice 4, is large enough to allow ingress and travel of subsurface vehicle 14 between lower roadway 8 and upper roadway 10.

Next referring to FIG. 2, the magnetic interconnection between surface vehicle 12 and subsurface vehicle 14 is shown whereby subsurface vehicle 14 travels between lower roadway 8 and upper roadway 10 such that surface vehicle 12 can be transported on upper roadway 10 by subsurface vehicle 14. As shown in FIG. 2 power supply 16 interconnects a lower conductive layer 18 and upper conductive layer 20. Lower conductive layer 18 is located on the upper side of lower roadway 8. Upper conductive layer 20 is located on the under side of upper roadway 10. Power supply 16 thus energizes lower conductive layer 18 and upper conductive layer 20. Subsurface vehicle 14 accesses the electrical power in lower conductive layer 18 and upper conductive layer 20 in a manner described below to travel on lower roadway 8. Power supply 16 can be either direct current or alternating current, of preferably a shock safe voltage level, for example, about 12 volts. Lower conductive layer 18 and upper conductive layer 20 consist of thin metal sheets, foil layers or a conductive coating that may be, for example, polymeric. The conductive sheet, coating or composite most preferably includes copper as the conductive metal.

Still referring to FIG. 2, subsurface vehicle 14 has a chassis 21 with an upper brush 22 located on the top of chassis 21 adjacent the under side of upper roadway 10 on which upper conductive layer 20 is located. Chassis 21 also has a lower brush 24 located on the under side thereof adjacent the upper surface of lower roadway 8 on which lower conductive layer 18 is located. Upper brush 22 and lower brush 24, which can be metal, graphite or conductive plastic, provide electrical interconnection between chassis 21 of subsurface vehicle 14 and upper conductive layer 20 and lower conductive layer 18, respectively for transfer of electrical power from power supply 16 to subsurface vehicle 14. Upper brush 22 and lower brush 24 are preferably elastic or spring loaded in order to accommodate changes in the distance between upper conductive layer 20 and lower conductive layer 18 to ensure a reliable electrical connection to subsurface vehicle 14. Upper brush 22 and lower brush 24 each have a head 25 that is contoured, or in another way shaped, for low friction sliding along upper conductive layer 20 and lower conductive layer 18, respectively, when subsurface vehicle 14 is in motion. Lower conductive layer 18 and upper conductive layer 20 can be located on substantially the entire upper surface of lower roadway 8 and under side of upper roadway 10, respectively, in order to ensure electrical interconnection of subsurface vehicle 14 to power supply 16 despite lateral movement across lower conductive layer 18 and upper conductive layer 20 by subsurface vehicle 14 due to, for example, turning of subsurface vehicle 14 or uncontrolled lateral movement thereof. Alternatively, lower conductive layer 18 and upper conductive layer 20 can be located in troughs or grooves in the upper surface of lower roadway 8 and the under side of upper roadway 10, respectively, into which head 25 of lower brush 24 and head 25 of upper brush 22, respectively, can reside in order to control the tracking of subsurface vehicle 14 in an electrically conductive environment by minimizing lateral movement of subsurface vehicle 14 relative to lower roadway 8 and upper roadway 10. Upper brush 22 and lower brush 24 are both electrically connected to control circuit 26 that is located on the front of chassis 21 of subsurface vehicle 14. Generally, control circuit 26 controls the electrical functioning of subsurface vehicle 14, and more specifically controls, and is electrically interconnected with, electromotor 28. Control circuit 26 thus controls the direction of movement, acceleration, deceleration, stopping, and turning of subsurface vehicle 14 based on external control signals, or control signals generated by subsurface vehicle 14 itself. Control circuit 26 is described in further detail below in conjunction with FIG. 8. Electromotor 28, electrically interconnected with control circuit 26, can be a direct current motor with brushes, a direct current brushless motor, or a stepper motor. Electromotor 28 is mechanically interconnected with transmission 30 that transfers rotation of electromotor 28 to drive wheel 32 employing the desired reduction ratio. More than one electromotor 28 can be employed for independent drive of a plurality of drive wheels 32. Additionally, transmission 30 can be a differential transmission to drive two or more drive wheels 32 at different speeds. In this manner, more sophisticated control of the acceleration, deceleration, and turning, for example, of subsurface vehicle 14 can be employed. Chassis support 34 is located on the under side of chassis 91 of subsurface vehicle 14. Chassis support 34 is spaced from drive wheel 32, also located on the under side of subsurface vehicle 14, and can be, for example, rollers or low friction drag plates that are preferably flexible to allow compensation for distance variation between lower roadway 8 and upper roadway 10. Magnets 36 are preferably disposed on the top of subsurface vehicle 14 adjacent the under side of upper roadway 10. Magnets 36 are preferably permanent magnets, but can also be electromagnets supplied with power from power supply 16 via control circuit 26.

Still referring to FIG. 2, surface vehicle 12, while preferably being a car, truck, or other vehicle, can be any type of device for which mobility is desired in the environment of a toy building set. Surface vehicle 12 includes wheels 38 which are rotatable to allow movement of surface vehicle 12 on upper roadway 10. Instead of wheels 38, a low friction drag plate can be employed. Magnets 40 are located on the under side of vehicle 12 adjacent upper roadway 10. Magnets 40 are sized and spaced on vehicle 12 to be aligned with magnets 36 on the top of chassis 21 of subsurface vehicle 14 for magnetic interconnection of surface vehicle 12 and subsurface vehicle 14. Magnets 36 are 0.1×0.125 inch round permanent rare earth magnets with residual flux around 9,000 Gauss. Preferably, the same type of magnets are employed for magnets 40 of surface vehicle 12. Reliable magnetic coupling has been observed at a distance of up to 0.2 inches between magnets 40 of surface vehicle 12 and magnets 36 of subsurface vehicle 14.

Next referring to FIG. 3, a preferred embodiment of subsurface vehicle 14 is shown. Subsurface vehicle 14 of FIG. 3 is designed to move between an ABS lower roadway 8 with a lower conductive layer 18 and an ABS upper roadway 10 with an upper conductive layer 20. Subsurface vehicle 14 of FIG. 3 has one drive wheel 32 and two chassis supports 34 having low friction pads 35. Two upper brushes 22 and two lower brushes 24 are preferably present and are made from copper. Upper brushes 22 and lower brushes 24 are loaded by torsion springs. The above configuration assures a substantially uniform force on drive wheel 32 regardless of the clearance between lower roadway 8 and upper roadway 10, and also facilitates passage of subsurface vehicle 14 along inclines or declines of lower roadway 8 and upper roadway 10. Two rear magnets 62 are located on chassis 21 for collision avoidance with another subsurface vehicle 14 as described further below. Electromotor 28 is preferably a direct current brush motor, for example, Namiki Model No. 10CL-1202, rated for 0.22 W maximum output at approximately 17,000 RPM at 4.5 volts of direct current power supply. Transmission 30 consists of a Namiki 100A gear train blocked with motor 28 along with a crown gear and associated pinions. The total reduction ratio of transmission 30 is 1:40, and the efficiency is about 25 percent. Subsurface vehicle 14 operates at speeds of up to 9 inches per second at an incline of up to 15°. Lower magnet 64, on the underside of chassis 21, guides subsurface vehicle 14, and associated surface vehicle 12, on lower roadway 8, and causes subsurface vehicle 14, and associated vehicle 12, to turn based on magnetic interaction with electromagnetic direction controllers adjacent lower roadway 8 described in further detail below. Lower magnet 64 is preferably conic shaped with a protruding tip and is most preferably a 0.5×0.2 inch permanent rare earth magnet with a residual flux of about 9,000 Gauss. The protruding tip 65 of lower magnet 64 is preferably steel for more precise guidance on lower roadway 8. A pair of Hall effect sensors 67 straddle control circuit 26 on the front of chassis 21 for control of surface vehicle 14 in a manner further described below.

Figure 4:
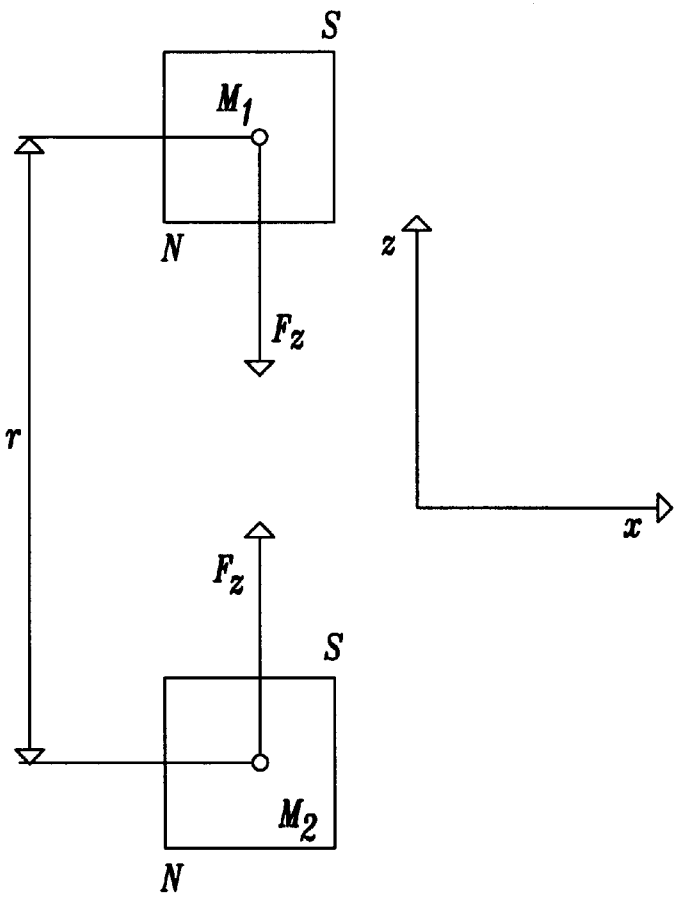
FIG. 4 is a diagrammatic section view of attractive forces between two magnets showing no offset.

Next referring to FIGS. 4–7, the principles of the magnetic forces interconnecting surface vehicle 12 and subsurface vehicle 14 by magnets 36 and magnets 40 are described. As shown in FIG. 4, when two magnets are placed one above the other, with opposite poles toward each other, a magnetic force Fz between them exhibits based on the following equation:

$$F_z \approx 6\frac{M_1 \cdot M_2}{r^4}$$

where r is the distance between parallel planes in which magnets are situated and $M_1$, $M_2$ are magnetic moments of both magnets. For permanent magnets. M is proportional to the volume of magnetic substance cross its residual flux density. For electromagnets, M is proportional to the number of turns cross the current.

Figure 5:
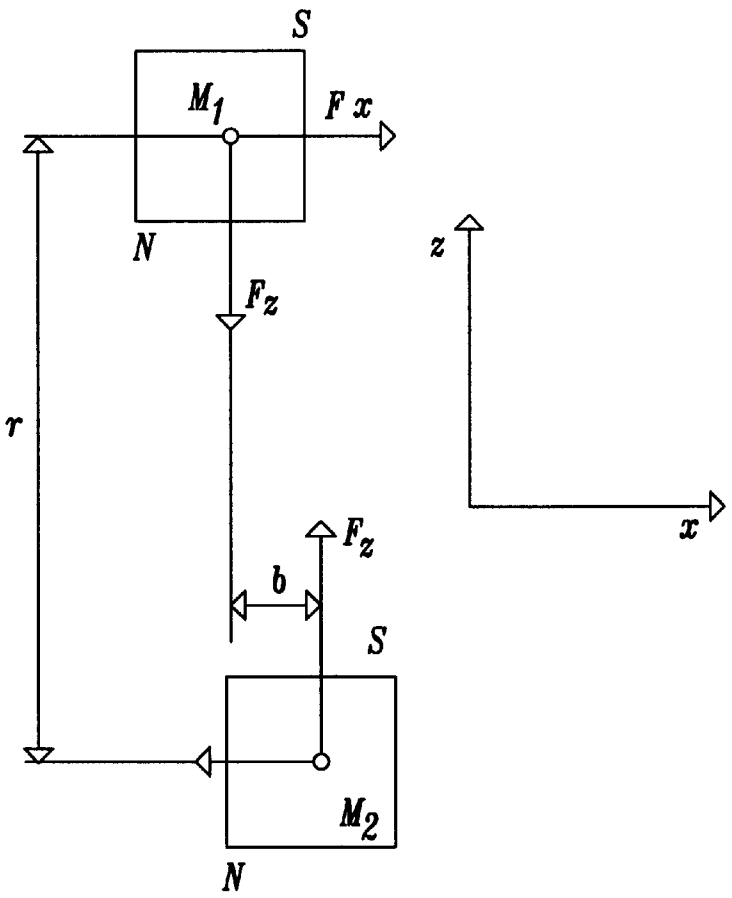
FIG. 5 is a diagrammatic section view of attractive forces between two magnets showing horizontal offset.

As shown in FIG. 5, when two magnets, one above the other, are shifted slightly to be horizontally offset by a distance b, the horizontal force $F_x$ occurs:

$$F_x \approx 6b\frac{M_1 \cdot M_2}{r^5}$$

Figure 6:
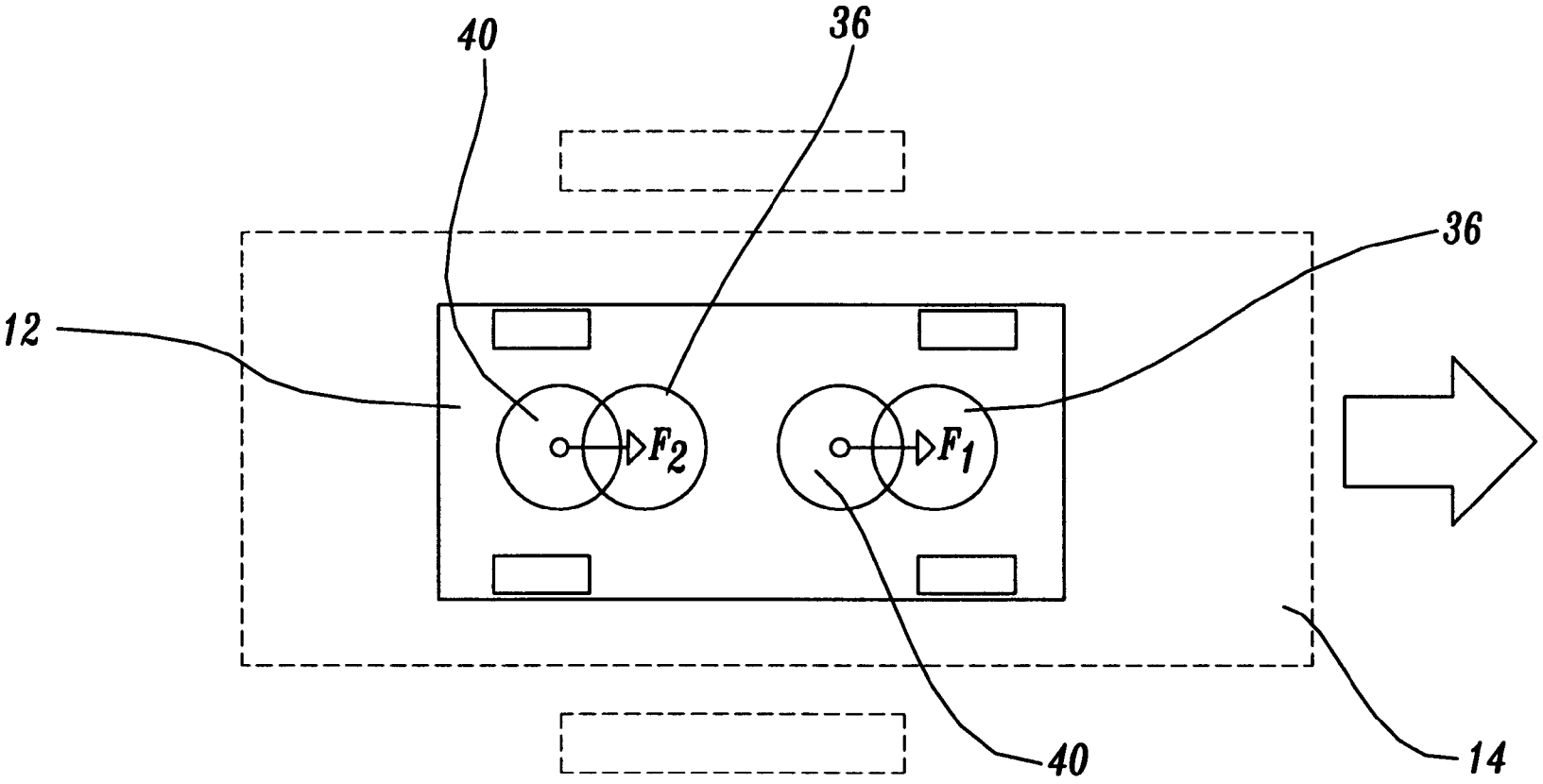
FIG. 6 is a diagrammatic plan view of the magnetic interaction between the surface vehicle and the subsurface vehicle of the present invention during straight movement.
Figure 7:
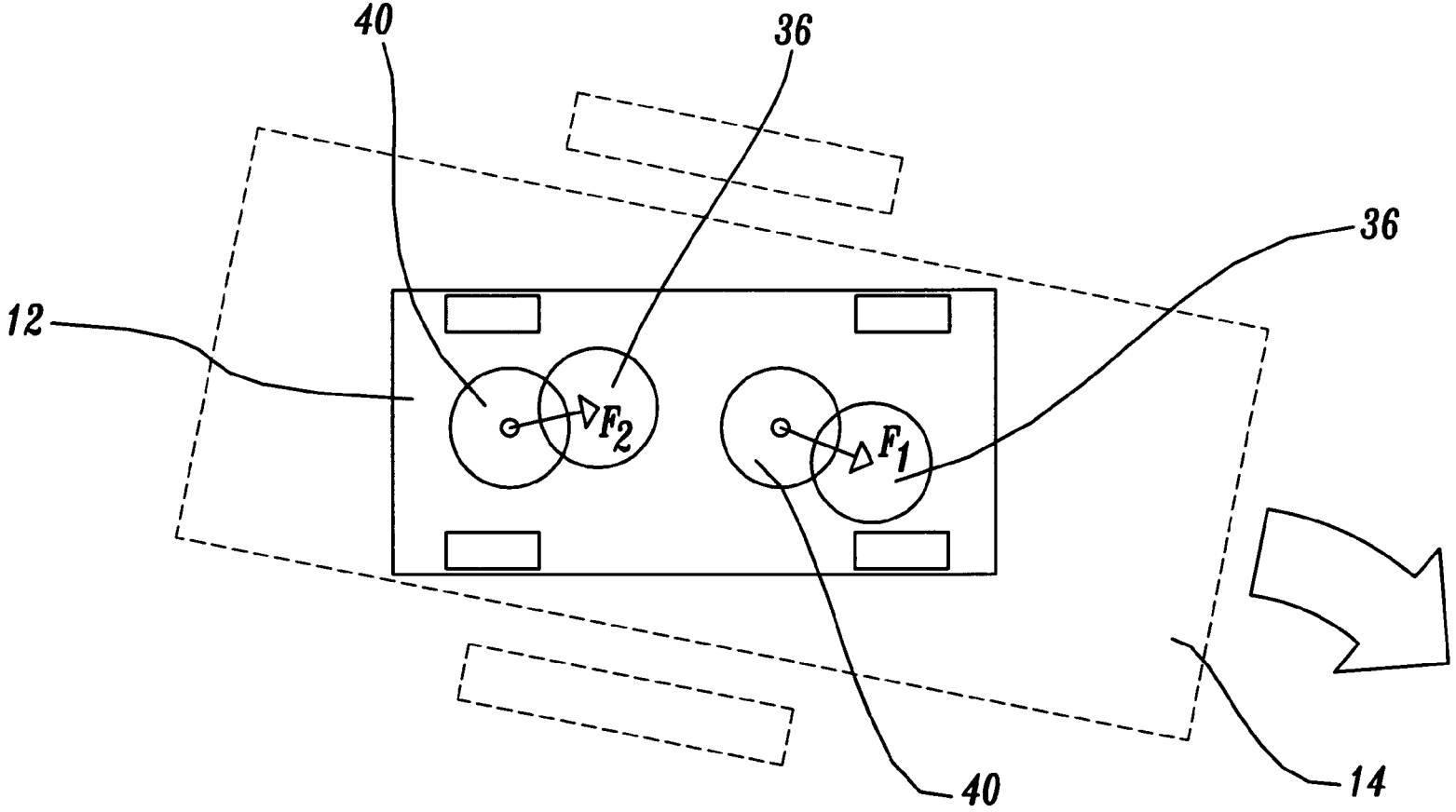
FIG. 7 is a diagrammatic plan view of the magnetic interaction between the surface vehicle and the subsurface vehicle of the present invention during a turn.

Next referring to FIGS. 6 and 7, the principles described above and shown in FIGS. 4 and 5 are discussed in relation to movement of nonpowered surface vehicle 12 by powered subsurface vehicle 14 due to the magnetic interconnection between magnets 40 of surface vehicle 12 and magnets 36 of subsurface vehicle 14. First referring to FIG. 6, during straight line movement, the horizontal offset b between surface vehicle 12 and subsurface vehicle 14 increases as subsurface vehicle 14 moves until forces F1 and F2 become large enough to overcome friction, inertia and, possibly, gravitational incline. At this point, surface vehicle 12 moves to follow subsurface vehicle 14. During a turn, as shown in FIG. 7, forces F1 and F2 have different directional vectors. Thus, forces F1 and F2 not only create thrust, but torque as well, that causes surface vehicle 12 to follow subsurface vehicle 14.

Figure 8:
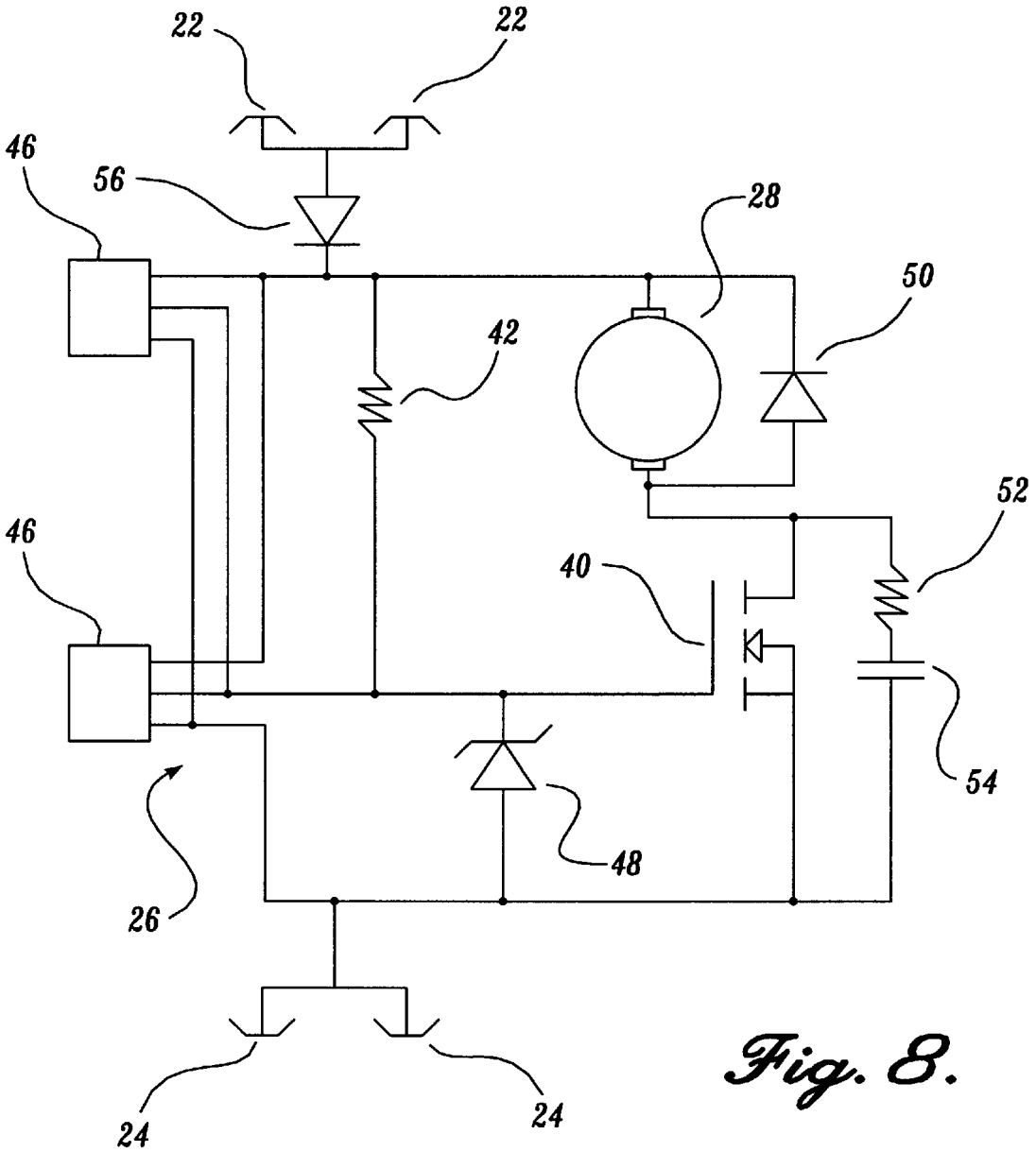
FIG. 8 is an electrical schematic of the control circuit of the subsurface vehicle of the present invention.
Figure 9:
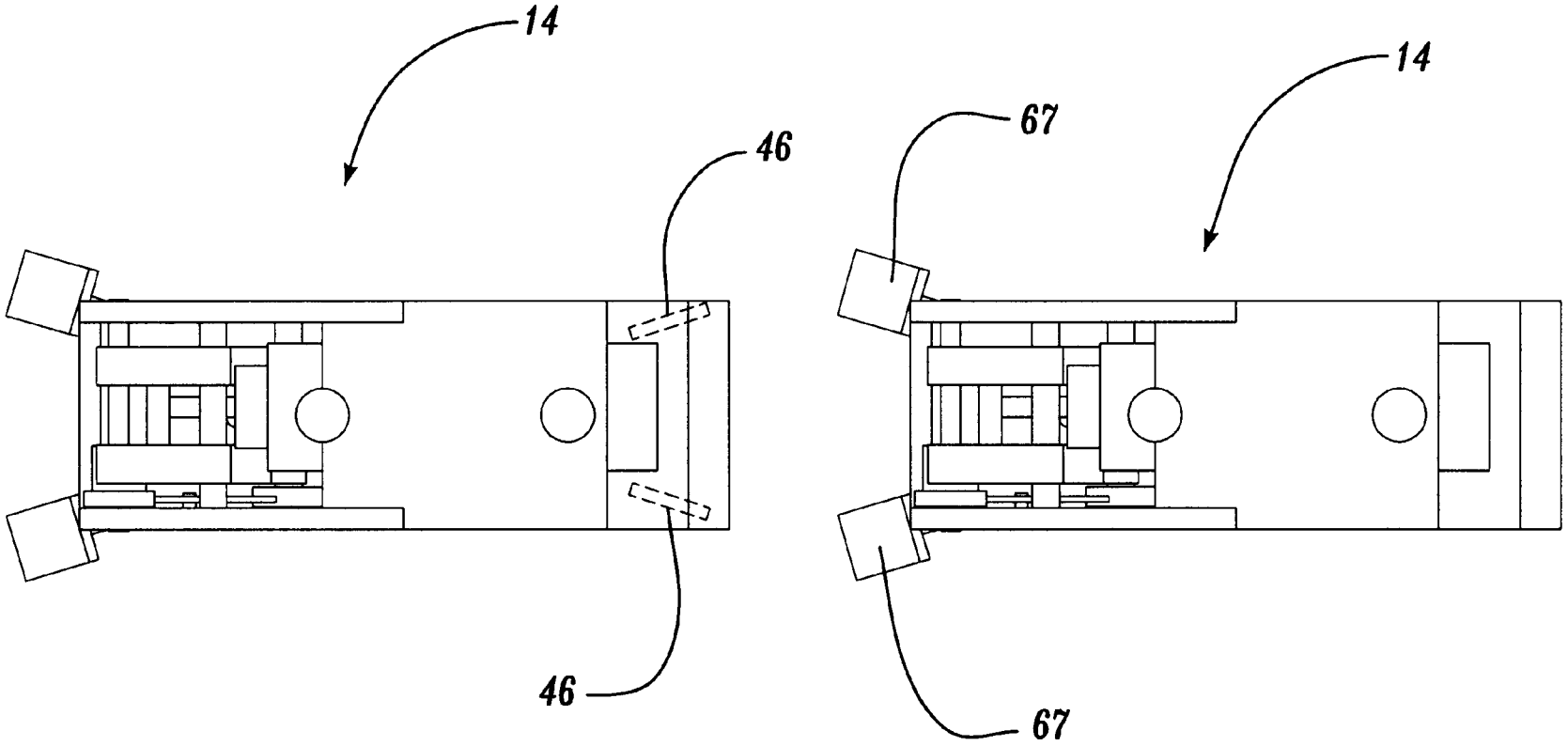
FIG. 9 is a plan view of a leading subsurface vehicle and a following subsurface vehicle showing collision avoidance thereof.

Now referring to FIG. 8, control circuit 26 is described in further detail. Control circuit 26 is electrically connected to both upper brushes 22 and lower brushes 24. Control circuit 26 includes an FET 40 (for example, model No. ZVN4206A manufactured by Zetex) that is normally open because of 10k Ohm pull-up resistor 42. However, FET 40 deactivates electromotor 28 if a magnetic control or collision signal is detected by a Hall effect sensor 46 (element 67 of FIG. 3) as further described below. Zener diode 48 (for example, model no. 1N5242 manufactured by Liteon Power Semiconductor) prevents overvoltage of the gate of FET 40. Diode 50 (for example, model no. 1N4448 manufactured by National Semiconductor), as well as an RC-chain consisting of 100 Ohm resistor 52 and 0.1 mcF capacitor 54, protect control circuit 26 from inductive spikes from electromotor 28. Diode 56 (for example, model no. 1N4004 manufactured by Motorola) protects control circuit 26 from reverse polarity of power supply 16. As shown in FIG. 9, Hall effect sensor 46 (element 67 of FIG. 9) of control circuit 26 is employed to prevent a rear end collision between a leading and a following subsurface vehicle 14. Control circuit 26 is preferably located on the front of following subsurface vehicle 14 so that Hall effect sensor 67 will be in close proximity to the magnetic field of rear magnet 62 of leading subsurface vehicle 14. When the following subsurface vehicle 14 closes to a predetermined distance, the magnetic field of rear magnet 62 of leading subsurface vehicle 14 is sensed by Hall effect sensor 67. Hall effect sensor 67 causes FET 40 to deactivate electromotor 28, thus stopping the following subsurface vehicle 14. When the leading subsurface vehicle 14 moves away from the following subsurface vehicle 14, the increased distance therebetween removes the magnetic field of rear magnet 62 of leading subsurface vehicle 14 from proximity to Hall effect sensor 67 of following subsurface vehicle 14. FET 40 thus activates electromotor 28 for movement of following subsurface vehicle 14.

Figure 10:
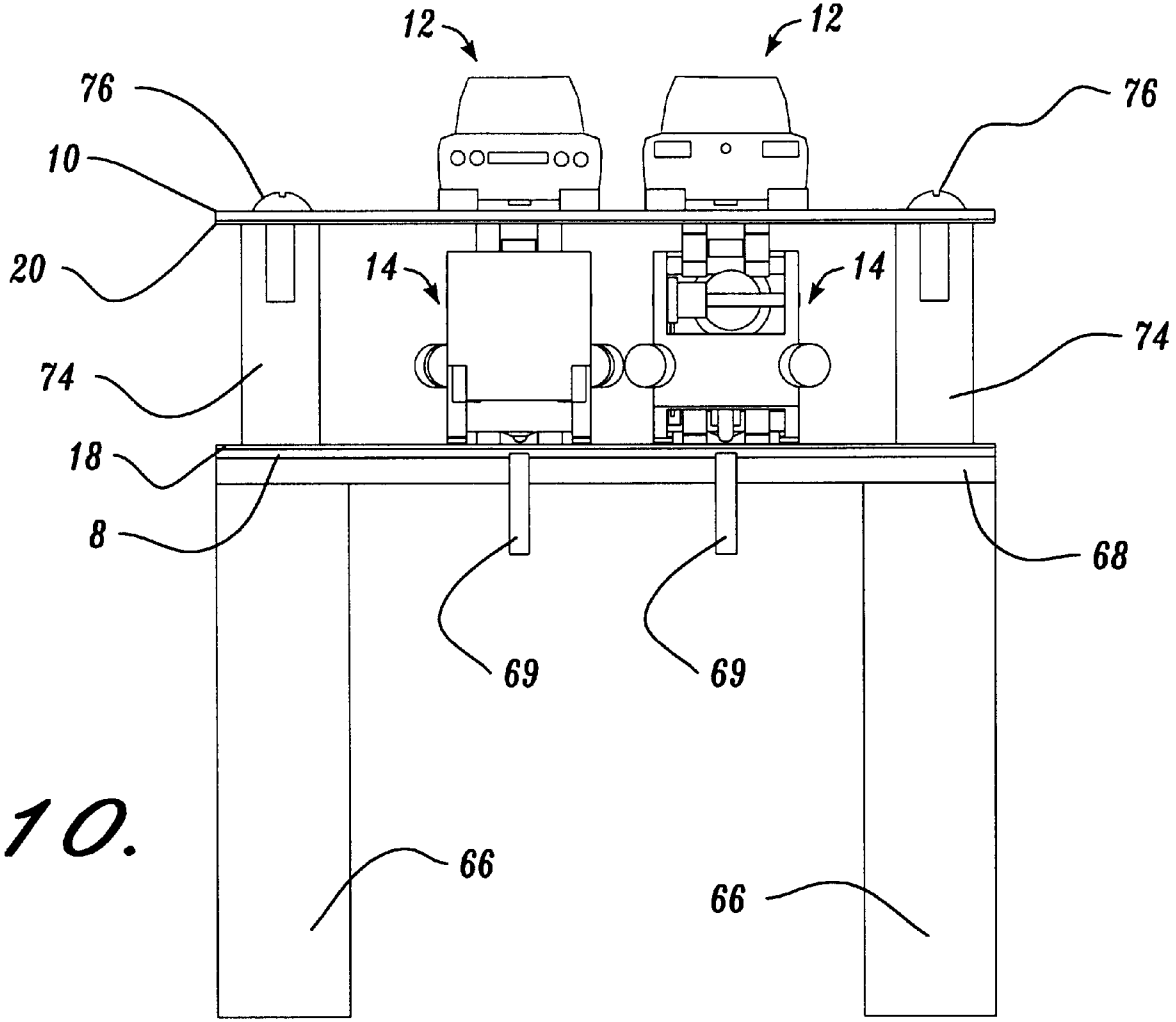
FIG. 10 is a transverse section view of the upper roadway, lower roadway, two surface vehicles and two powered subsurface vehicles of the present invention.
Figure 11:
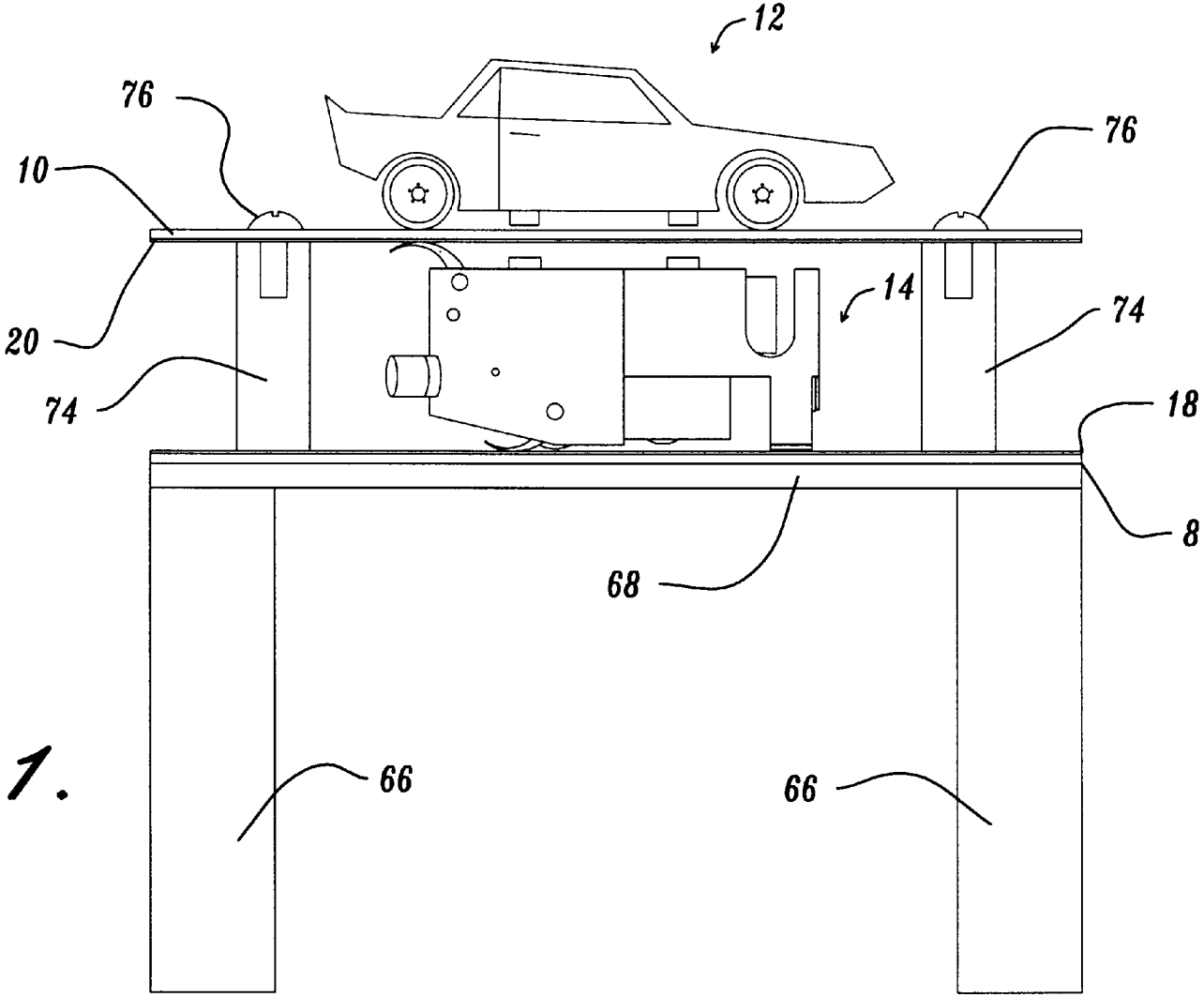
FIG. 11 is a diagrammatic side section view of the upper roadway, lower roadway, surface vehicle and powered subsurface vehicle of the present invention.
Figure 12:
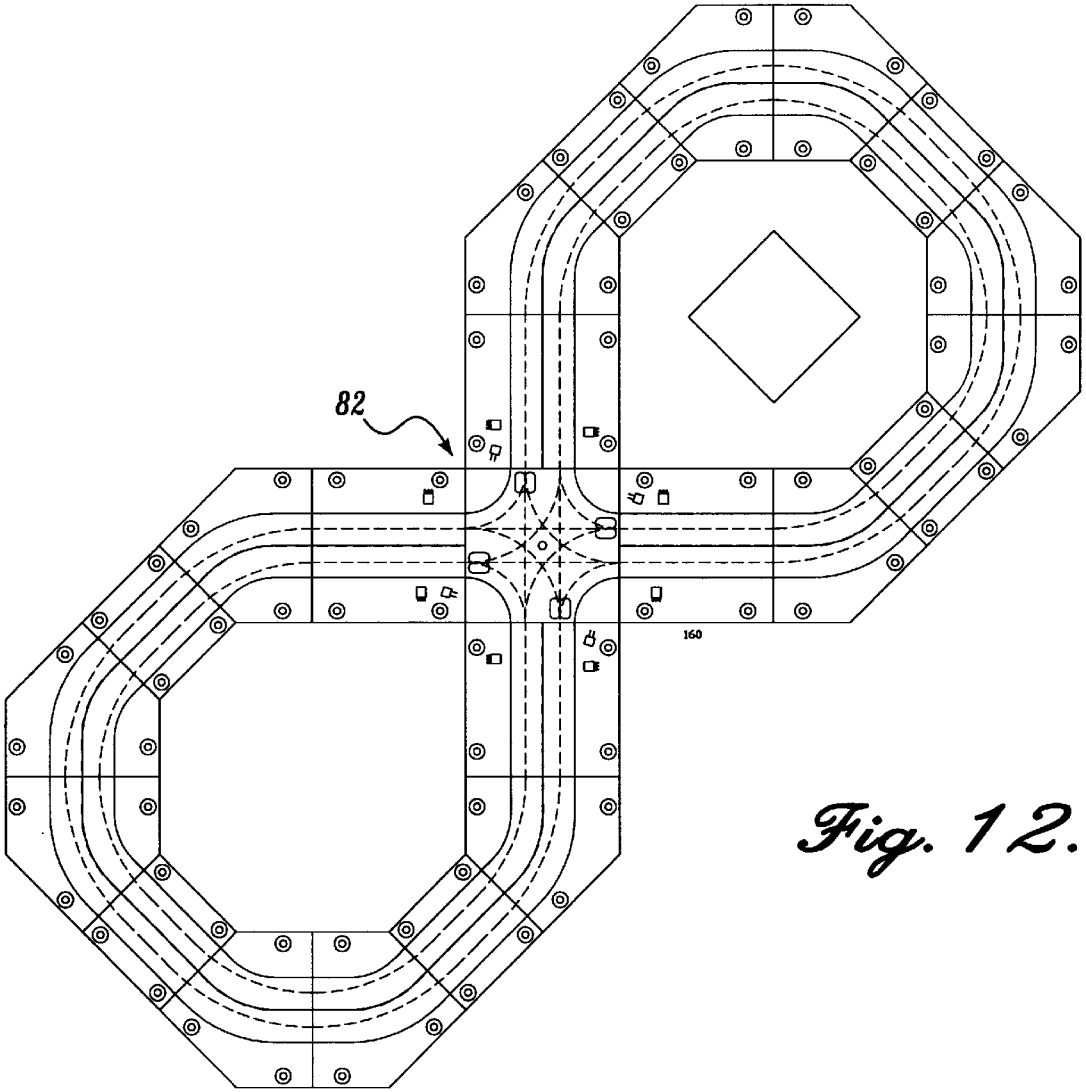
FIG. 12 is a plan view of the lower roadway of the present invention with electromagnetic direction controllers.

Next referring to FIGS. 10 and 11, further structural detail of one embodiment of lower roadway 8 and upper roadway 10, between which subsurface vehicle 14 travels, is shown. Lower vertical supports 66 are aligned in two spaced apart sets to support horizontal plate 68, which is preferably comprised of aluminum or other metal alloy. Horizontal plate 68 is the foundation for lower roadway 8, which is preferably comprised of ABS. As stated above, lower conductive layer 18, comprised of nickel or other conductive material, is located on lower roadway 8. Lower brushes 24 are in electrical communication with lower conductive layer 18, Thus, longitudinal steel strip 69 passes through horizontal plate 68 and is nested in lower roadway 8 at a sufficient depth such that lower magnet 64, and specifically steel tip 65 thereof, is attracted to steel strip 69 for guidance of subsurface vehicle 14. Upper vertical supports 74 are preferably spaced apart in two sets. On the upper ends of upper vertical supports 74 is upper roadway 10, having upper conductive layer 20, preferably made of nickel or other conductive alloy, on its underside. Bolts 76 are employed to removably secure upper roadway 10 and upper conductive layer 20 to upper vertical supports 74. Upper vertical supports 74 preferably have a height precisely defined to allow electrical communication between lower brushes 24 of subsurface vehicle 14 and lower conductive layer 18, as well as between upper brushes 22 of subsurface vehicle 14 and upper conductive layer 20.

Figure 13A:
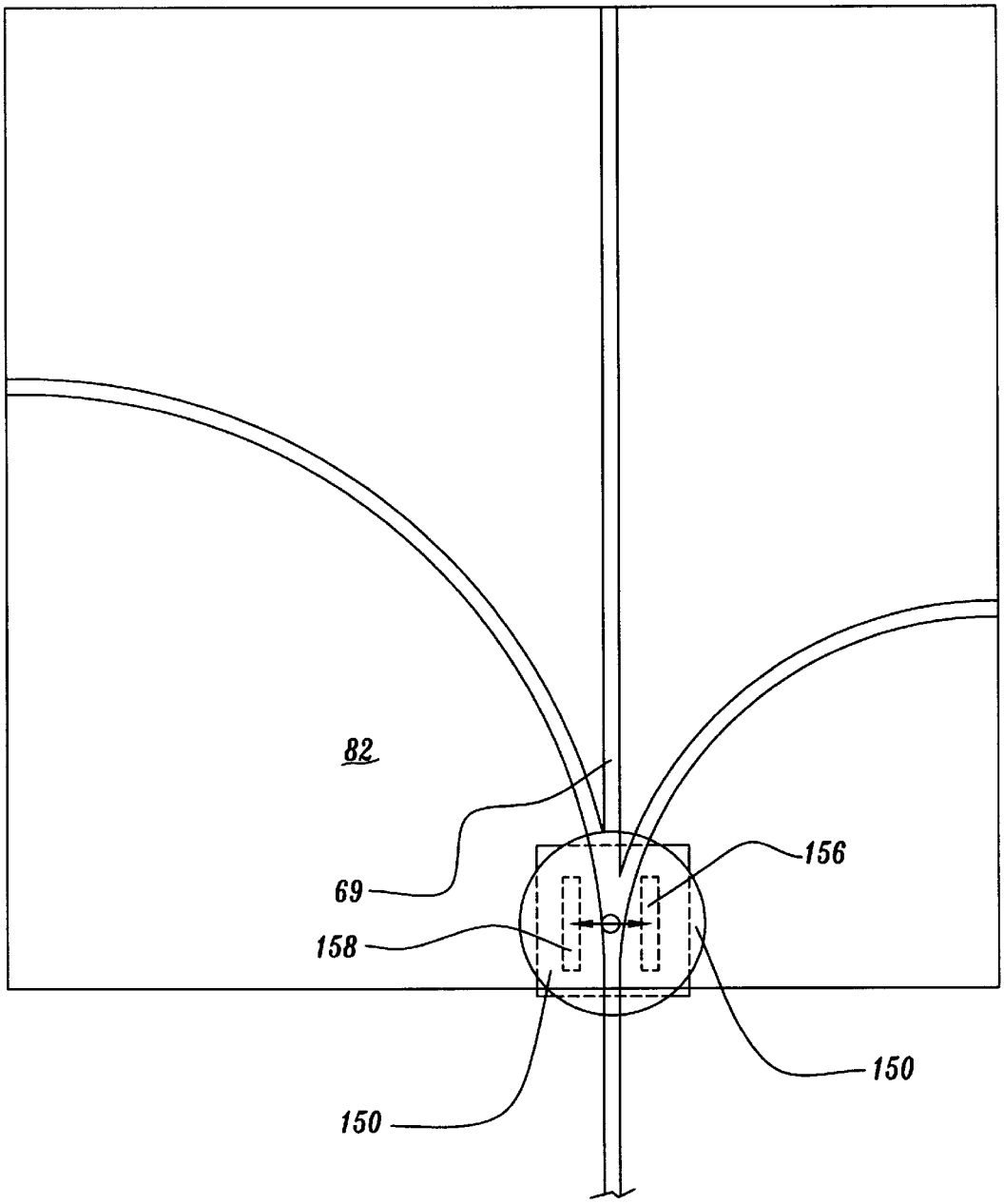
FIG. 13A is a detail view of the electromagnetic direction controllers of FIG. 12.
Figure 13B:
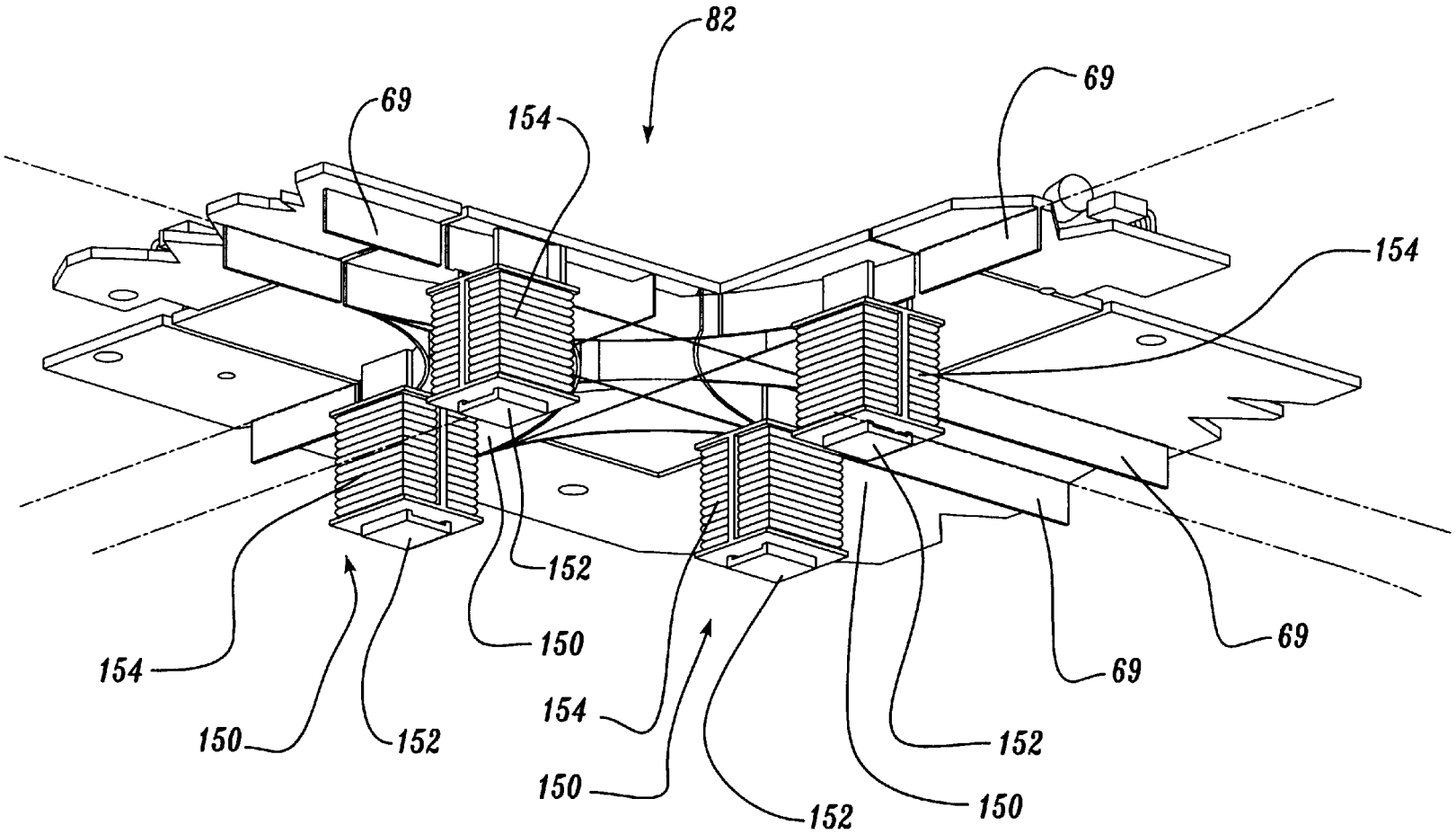
FIG. 13B is a partially exposed isometric view of the electromagnetic direction controllers of FIG. 12.

Referring to FIGS. 12, 13A, 13B and 14, intersection 82 and the electromagnetic direction control components thereof are shown in detail. As best shown in FIGS. 13A and 13B, an electromagnet 150 is located under each lower roadway 8 where the lower roadway 8 joins with intersection 82. Each electromagnet 150 is comprised of a U-shaped core 152 with a two section coil 154 thereon. U-shaped core 152 is preferably comprised of low carbon steel and coil 154 is preferably comprised of about 4,000 turns of #40 copper wire. Each electromagnet 150 is connected to an electric power source known in the art such that current in two alternating directions can selectively be passed through coil 154. In this manner, poles 156 and 150 of U-shaped core 152, which straddle steel strip 69, can be configured with either pole 156 being positive and pole 158 being negative, or pole 156 being negative and pole 158 being positive. Poles 156 and 158 can thus either attract or repel the pole of lower magnet 64 of subsurface vehicle 14 adjacent steel strip 69, depending upon the direction of current flow through electromagnet 150 that has been selected. With current flowing through electromagnet 150 in a first direction, pole 156 will thus attract lower magnet 64 of subsurface vehicle 14 and pole 158 will repel lower magnet 64 to guide subsurface vehicle 14 in a first direction, i.e., right. Reversing the direction of the current through electromagnet 150 will cause pole 156 to repel lower magnet 64 and pole 158 to attract lower magnet 64 to guide subsurface vehicle 14 in a second direction, i.e., left. No current flow through electromagnet 150 results in no magnetic interaction of poles 156 and 158 with lower magnet 64, and subsurface vehicle 14 proceeds straight.

Figure 14:
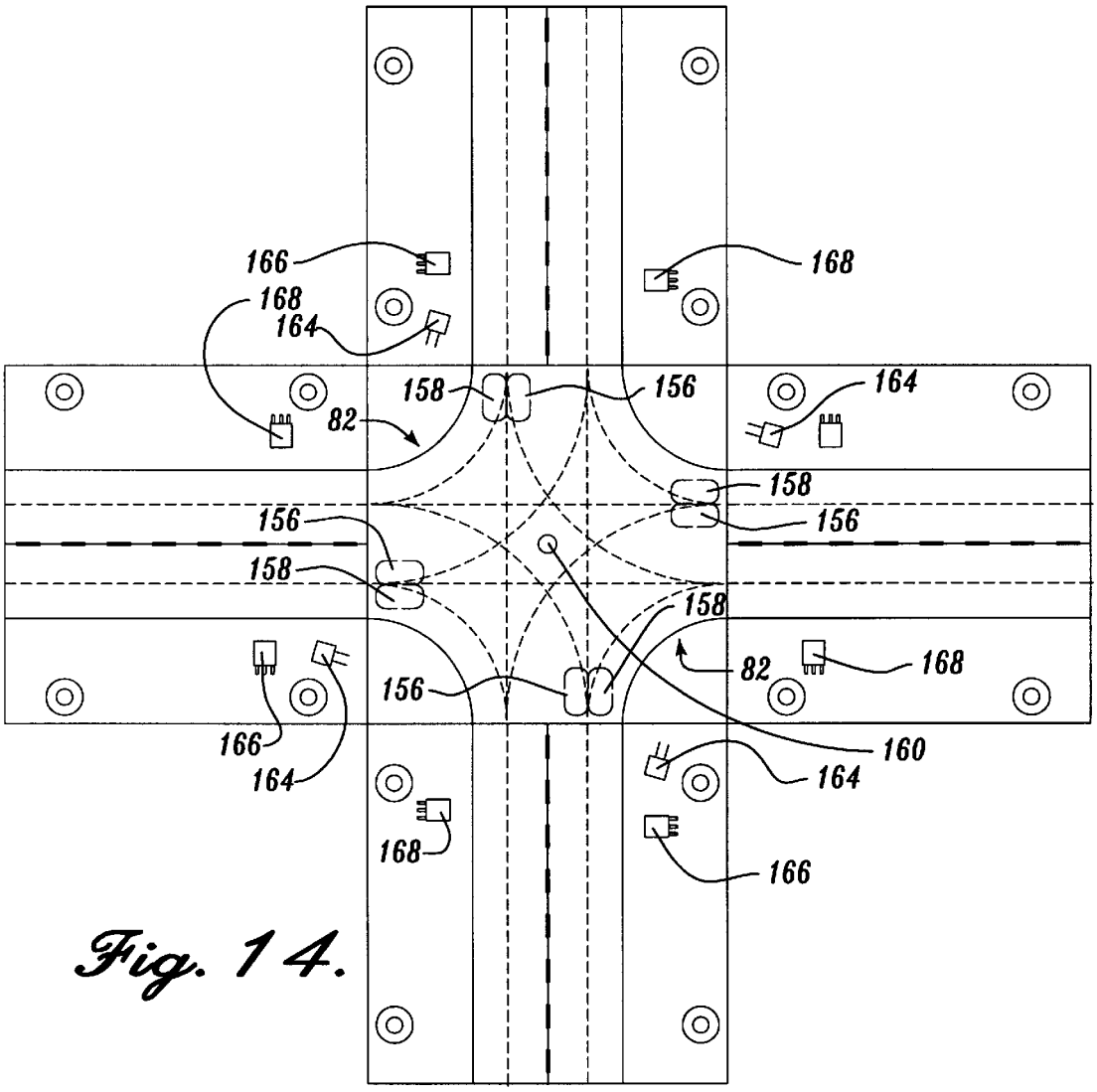
FIG. 14 is a detail plan view of FIG. 12 showing the electromagnetic direction controllers of the present invention.

As shown in FIG. 14, in addition to electromagnet 150 and associated poles 156 and 158, each intersection 82 includes a directional light detector 160 that is actuatable by a remote control unit described in further detail below. When actuated, directional light detector 160 of this specific intersection 82 receives control commands from a remote control unit to selectively control the electromagnets 150 as well as stop coils 164 of the specific intersection 82 as further described below. Stop coils 164 are electromagnets located on each lower roadway 8 adjacent intersection 82 that, when energized, actuate Hall effect sensors 67 to deactivate motor 28 of subsurface vehicle 14, thus stopping subsurface vehicle 14 prior to entering intersection 82 in order to control multiple vehicle traffic. Hall effect sensors 166, located on each lower roadway 8 adjacent intersection 82, detect when a subsurface vehicle 14 is approaching intersection 82. Hall effect sensors 168, also located on each lower roadway 8 adjacent intersection 82, detect when a subsurface vehicle 14 has left intersection 82. The data from directional light detector 160, Hall effect sensors 166 and Hall effect sensors 168 are fed to microprocessor U1 of FIG. 16 to control intersection traffic, as described below.

Figure 15:
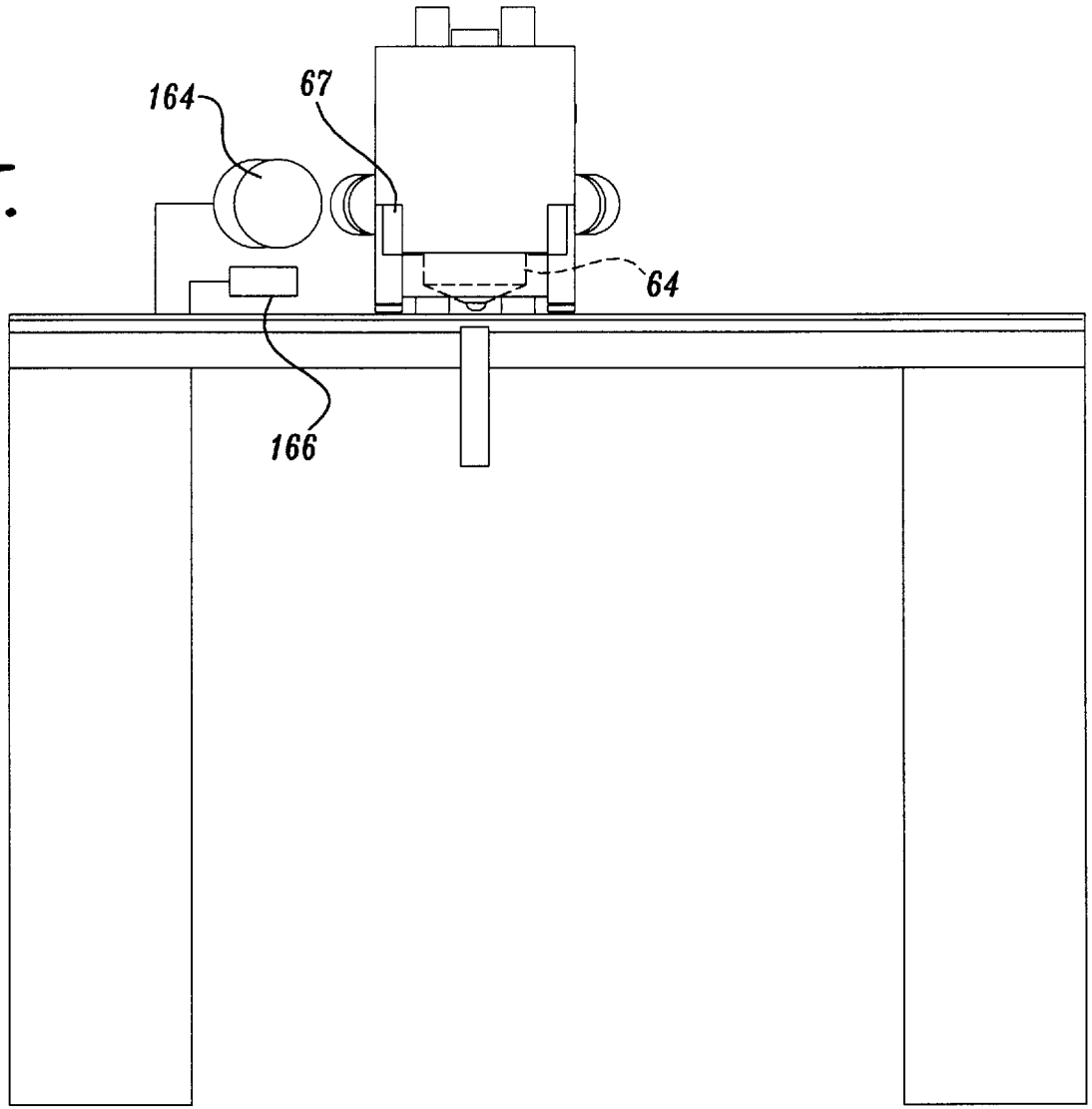
FIG. 15 is a diagrammatic section view of the interaction between the guidance control elements located adjacent an intersection and on the subsurface vehicle of the present invention.

Referring to FIG. 15, the orientation of stop coil 164, Hall effect sensor 166 and Hall effect sensor 168 proximate to Hall effect sensor 67 and lower magnet 64 of subsurface vehicle 14 is shown. Hall effect sensor 166 adjacent intersection 82 senses lower magnet 64 of approaching subsurface vehicle 14. This data is processed by microprocessor U1 of FIG. 16, below, to activate stop coil 164. Stop coil 164 triggers Hall effect sensor 67 of subsurface vehicle 14 to deactivate motor 28, thus stopping subsurface vehicle before it enters intersection 82. Hall effect sensor 168 detects lower magnet 64 of a subsurface vehicle 14 as it leaves intersection 82 and relays this data to microprocessor U1. The above interaction between stop coils 164, Hall effect sensor 166, Hall effect sensor 67, lower magnet 64 and microprocessor U1 ensures that after one subsurface vehicle 14 has entered intersection 82, all other subsurface vehicles 14 are detained until that subsurface vehicle 14 has left intersection 82.

The above electromagnetic direction controllers of the present invention can be employed in a random mode whereby a Hall effect sensor 164 of a lower roadway 8 senses the approach of a subsurface vehicle 14, as described above. Microprocessor U1 then activates electromagnet 150 of the appropriate lower roadway 8 and randomly selects the current direction (or no current) so the subsurface vehicle 14 will randomly turn left, right or proceed straight through the intersection 82. When microprocessor first activates electromagnet 150, all stop coils 164 leading to intersection 82 are energized to block all traffic. After about 100 mseconds, the stop coil 164 of the lower roadway 8 on which the subsurface vehicle 14 to be controlled is located is deactivated by microprocessor U1 so that the subsurface vehicle 14 can enter intersection 82 to be guided by electromagnet 150. If more than one subsurface vehicle 14 is present at the intersection, microprocessor U1 commands them based on their order of arrival at intersection 82.

The above electromagnetic direction controllers of the present invention can be employed in a user control mode employing light detector 160 of intersection 82, described above, to provide specific user command to allow a particular subsurface vehicle 14 to be guided in a specific direction through intersection 82. This user controlled mode operates substantially the same as the above random mode except that microprocessor U1 of FIG. 16 does not randomly energize electromagnet 150 of the subject lower roadway 8. Instead, microprocessor U1 follows the command signals it has received from light detector 160 to energize electromagnet 150 in the manner directed by the user to accomplish the desired direction of movement of subsurface vehicle 14. As in the above random mode all stop coils 164 are first energized, with one subsequently opened. Also, commands are followed by microprocessor U1 in the order received.

Figure 16:
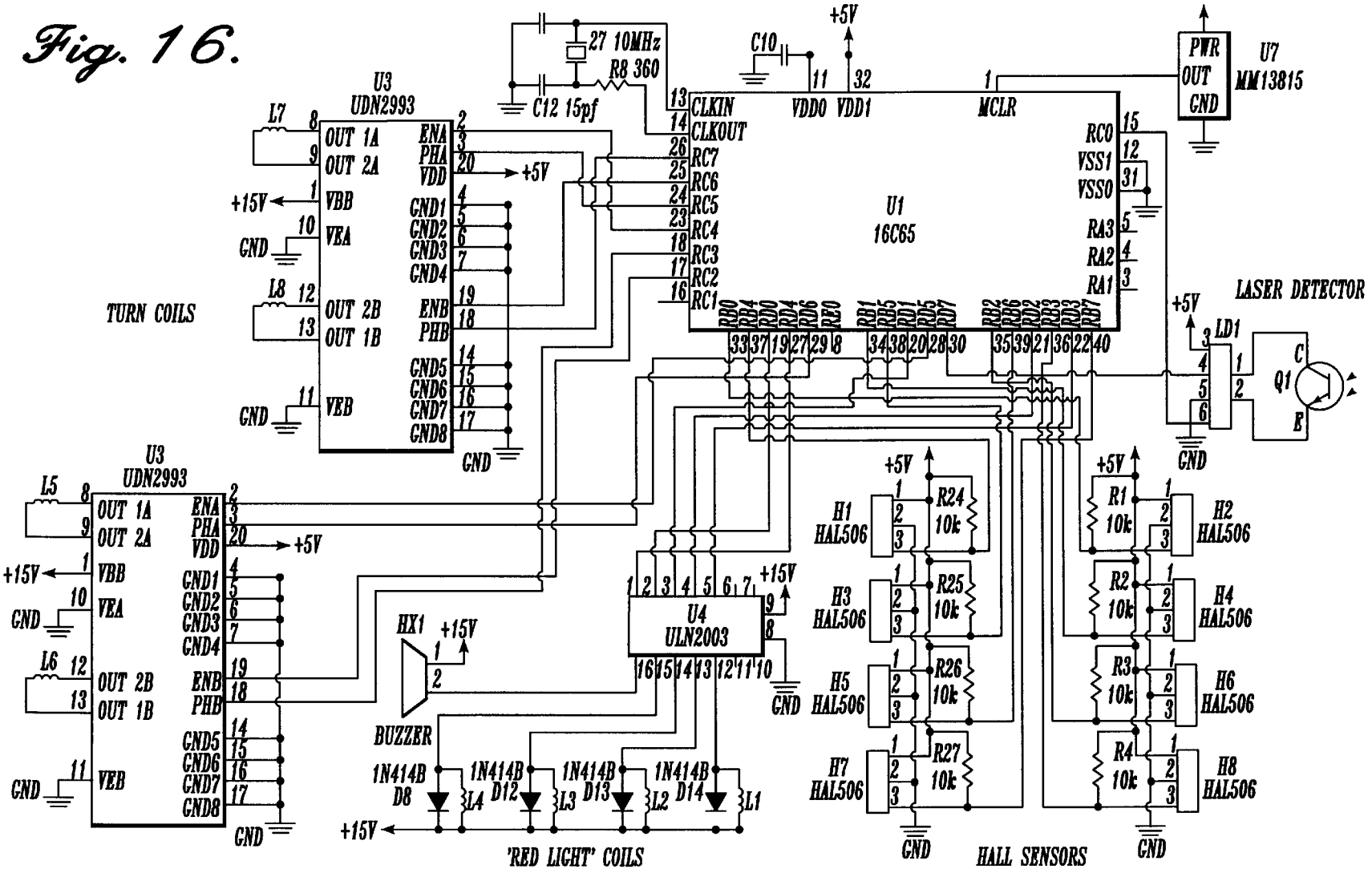
FIG. 16 is an electrical schematic of the guidance control electronics of the intersection of FIG. 12 of the present invention.

Next referring to FIG. 16, the electrical circuitry of the electromagnetic guidance control of intersection 82 is described. All logic functions are performed by an eight-bit microcontroller U1 (for example, model No. PIC16C65, manufactured by Microchip). Microcontroller U1 is clocked by a 10 MH quartz crystal X1, for example, model No. A143E manufactured by International Quartz Devices. Voltage monitor U7, for example, model No. 1381S manufactured by Panasonic, is responsible for the power-up reset and power supply fault protection. When the logic supply voltage (plus 5 V) drops below 4.2 V, the voltage detector drives LOW the MCLR pin of microcontroller U1, thus shutting it down to prevent it from operation at reduced power supply voltage. When the logic supply voltage (plus 5 V) is above 4.2 V, the voltage detector drives HIGH the MCLR pin of microprocessor U1, thus resetting it and reinitializing the system. Two full bridge drivers U5, for example, model No. UDN2993, manufactured by Allegro, drive electromagnets L5, L6, 1,7 and L8 (element 150 of FIGS. 13A and 13B) of intersection 82. When pin ENA of driver U5 is HIGH, the state of pin PHA determines the direction of the current through the selected electromagnet L5–L8, and thus the turn direction of a subsurface vehicle 14. When pin ENA of the full bridge driver U5 is LOW, no current flows through the selected electromagnet L5–L8 and the subsurface vehicle 14 proceeds straight regardless of the state of pin PHA. Stop coils L1–L4 (element 164 of FIGS. 13A and 13B) are driven through Darlington array U4, for example, model No. ULN2003, manufactured by Motorola. Another channel of Darlington array U4 drives a buzzer or other sound device HN1, for example, model No. P9948 manufactured by Panasonic that provides user feedback for the hand-held remote control device. Hall effect sensors 166, described above, are designated H1–H4 and are, for example, model No. HAL506 manufactured by ITT Semiconductors. Hall effect sensors 166 sense when a subsurface vehicle enters intersection 82. Hall effect sensors 168 are designated H5–H8 in FIG. 16, sense when a subsurface vehicle leaves intersection 82, and are preferably the same model as hall effect sensors H1–H4. When activated by side magnet 64 of a subsurface vehicle 14, Hall effects sensors H1–H8 drive LOW inputs RB4–RB8 of microcontroller U1, thus denoting that a subsurface vehicle 14 has entered or left intersection 82. Since Hall effect sensors HI1-H8 are open collector outputs, pull-up resistors R24–R27 are necessary to drive inputs of microprocessor U1 HIGH when no subsurface vehicle 14 is detected. Light detector 160, described above, is denoted as LD1 and is connected directly to inputs of microprocessor U1 to provide input as to the desired electromagnetic configuration of intersection 82 upon receipt of control signals from a remote control unit further described below. The active level of light detector LD1 is HIGH. The information pertaining to the desired direction of subsurface vehicle 14 from the remote control interface is transmitted serially to microprocessor U1 and is then decoded. The above circuit requires three power supply voltages: +5 V, +15 V, and the voltage of the subsurface vehicle 14 that is adjustable between +3 V and +6 V.

Figure 17A:
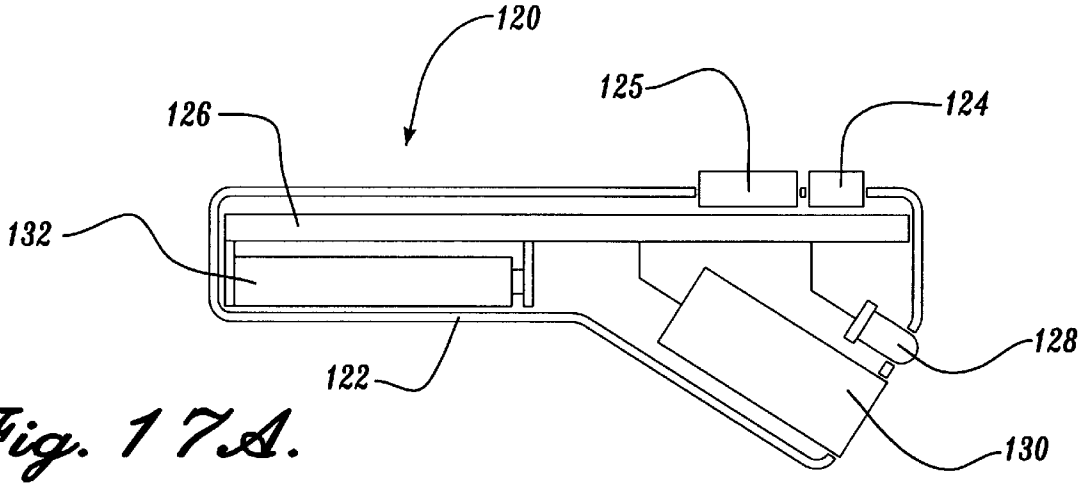
FIG. 17A is a section through the hand unit of the optoelectric remote control apparatus of the present invention.
Figure 17B:
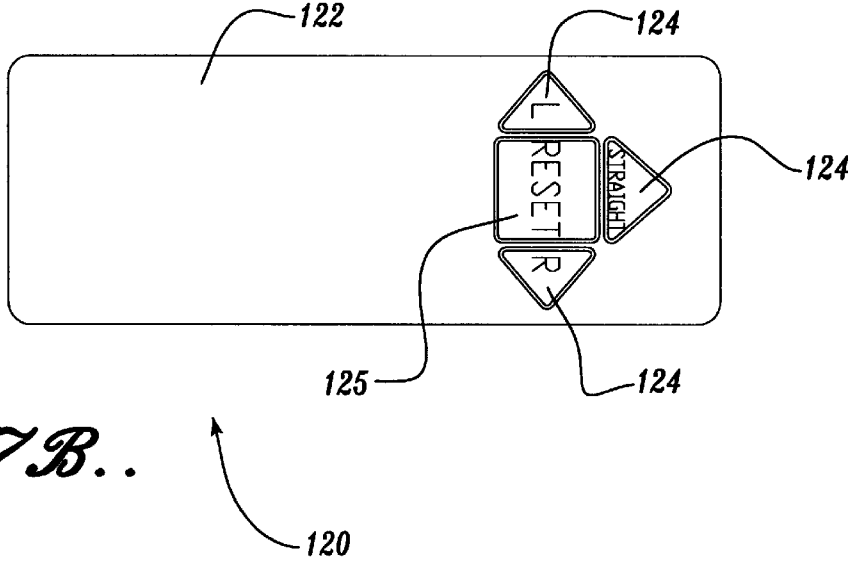
FIG. 17B is a plan view of the hand unit of the optoelectric remote control apparatus of the present invention.

Referring to FIGS. 17A–19, the optoelectric remote control apparatus of the present invention is described in detail. Referring specifically to FIGS. 17A and 17B, hand unit 120 includes case 122, that is preferably comprised of a plastic or other synthetic polymer. Case 122 has a plurality of direction keys 124 protruding through the upper surface thereof. Direction keys 124 transmits signals from hand unit 120 in a manner further described below. Case 122 holds circuit board 126 that has thereon electric circuitry, further described below, that allows vehicle control by the use of hand unit 120. Case 122 also houses directional light transmitter 130. While directional light transmitter 130 is shown, any directional energy source capable of transmitting a coded control signal can be employed, such as a low energy laser or columnated light source. Directional light transmitter 130 is electronically interconnected with circuit board 126. Directional light transmitter 130 has an optical transmission element that protrudes out of the front of hand unit 120 for transmission of directional light signals. Power source 132 is also contained within case 122 and provides electrical power to circuit board 126 and directional light transmitter 130. Power source 132 is preferably comprised of batteries such as, for example, 2 AA size batteries. Hand unit 120 transmits one of four, for example, commands, i.e., left, right, start, stop, via a frequency modulated directional light signal that is received by light detector LD1 of FIG. 16 (i.e., light detector 160 of FIG. 14), light detector LD1 preferably being associated with microprocessor U1 that controls one or more intersections 82, as described above. Thus, because the directional light signal generated by hand unit 120 that provides control commands is unidirectional, a single directional light detector 160 (LD1) usually can be present at each intersection 82. Since the light signal from hand unit 120 is directionally specific, when hand unit 120 is pointed at a specific one of light detectors 160 (LD1) associated with a specific one of intersections 82, this light detector 160 (LD1), and only this light detector 160 (LD1), is activated by the signal from hand unit 120 to receive the control commands. As stated above in regard to FIG. 16, the visible light detector 160 (LD1) that is activated by the directional light signal from hand unit 120 provides a control command input to microprocessor U1. Microprocessor U1 of FIG. 16 will therefor apply a "right turn" command, for example, sent by the directional light signal of hand unit 120 to light detector 160 (LD1) to the specific locale with which the activated light detector 160 (LD1) is associated. The directional light signal generated by hand unit 120 is therefor a control signal for a locale of an intersection 82 that is location (i.e., intersection) specific depending on which light detector 160 (LD1) is activated.

The directional light control data transmission of directional light transmitter 130 of hand held unit 120 employs frequency modulation. Radiation with a carrier wave length of about 670 nm is modulated by on/off signaling with four different frequencies, 0.4645, 0.316, 0.3097, and 0.2477 kHz. Each of the above four frequencies corresponds to one of the commands left, right, start and stop, respectively.

Figure 18:
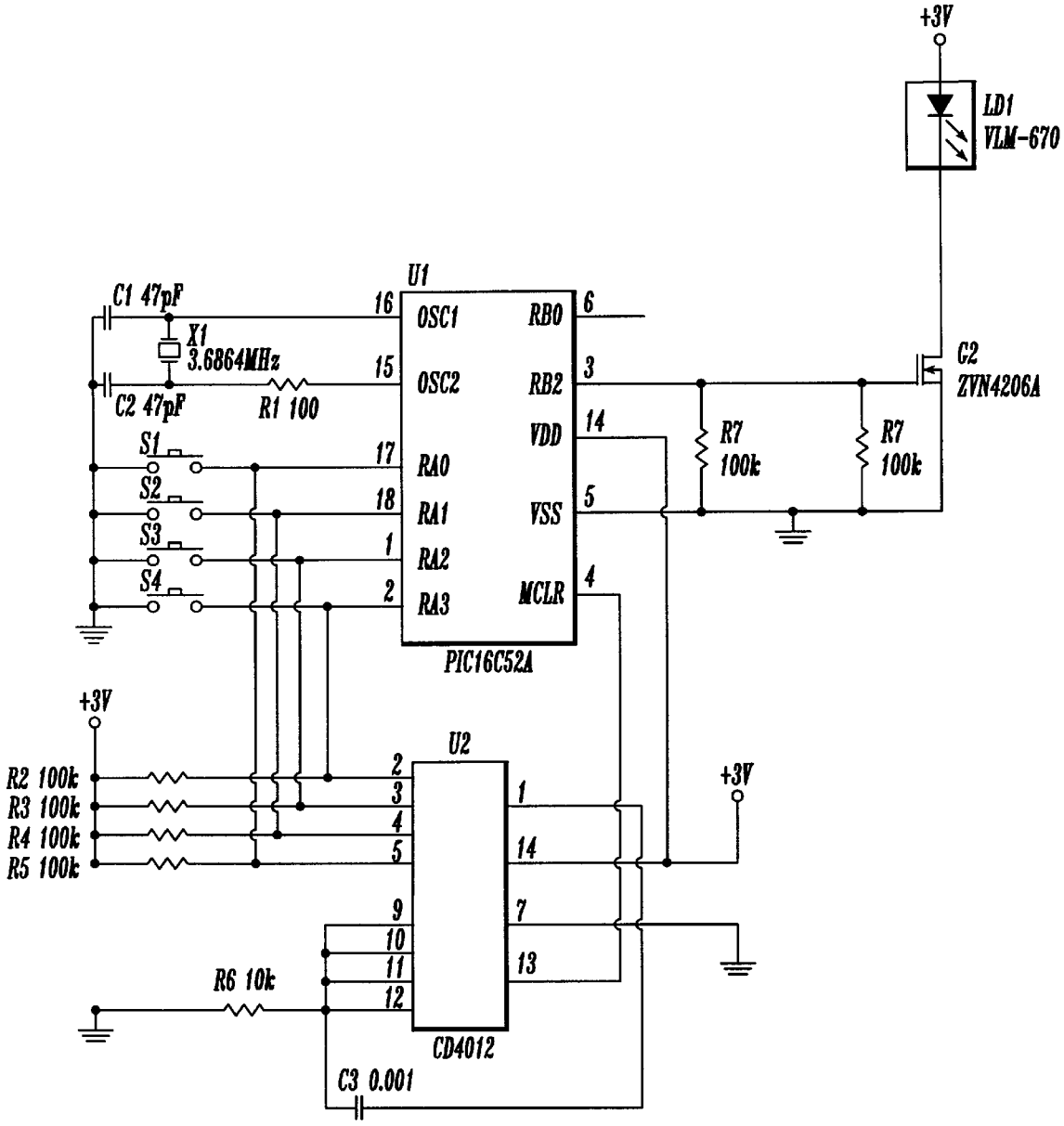
FIG. 18 is an electrical schematic of the circuitry of the hand unit of the optoelectric remote control hand apparatus of the present invention.

Next referring to FIG. 18, the electronic circuitry of control board 126 of hand unit 120 is described in detail. The control circuitry is based on an 8-bit microprocessor U1 which is preferably, for example, model No. PIC16C58, manufactured by Microchip. Microprocessor U1 has a software/hardware controllable "sleep" mode that provides oscillator shutdown and decreases the quiescent current of microprocessor U1 to less than 1 $\mu$A. Thus, microprocessor U1 is always powered, and no power switch is required for hand unit 120. To activate microprocessor U1 from its quiescent state, a short LOW pulse is applied to reset pin MCLR. A circuit based on dual 4NAND gates U2, for example, model No. CD4012, manufactured by National Semiconductor, generates this short LOW pulse. Depression of any of direction keys 124 will generate the above short positive pulse. However, when hand unit 120 is not in use and direction keys 124 is not being depressed, all inputs of the first section of gate U2, pins 2, 3, 4, and 5, are pulled up by 100k resistors R2, R3, R4, and R5, and the output of the first section of gate U2, pin 1, is LOW. However, inputs of the second section of gate U2, pins 9, 10, 11, and 12, are driven LOW by a common pull-down 10k resistor R6, and the output of the second section of gate U2, pin 13, keeps HIGH the MCLR input of the microprocessor U1. In contrast, when any of the direction keys 124 is pressed, the appropriate input of gate U2 goes LOW and the output, pin 1, goes HIGH, thus generating a short positive pulse with a differentiator chain composed of 0.001 $\mu$F capacitor C3 and 10k resistor R6. This pulse is inverted by the second section of gate U2 and is negative at the MCLR input of microprocessor U1, thus activating microprocessor U1 from its quiescent state. The microprocessor U1 then starts its internal oscillator, stabilized by a 3.6864 MHz quartz crystal X1, for example, model No. A16M, manufactured by International Quartz Devices. Microprocessor U1 then determines which control key 124 has been pressed by analyzing inputs RA0, RA1, RA2 and RA3. The input associated with the activated key is LOW, while all the other inputs associated with the other keys are driven HIGH by pull-up resistors R3, R4, and R5. If more than one of direction keys 124 is pressed, priority is given to the input with the lowest number input, RA0–RA3. Microprocessor U1 then functions as a programmable frequency divider, providing pulse sequences based on which one of the direction keys 124. The appropriate signal frequency is selected for the one of direction keys 124 that had been pressed. The appropriate visible light pulse sequence is applied to the gate of FET Q1, for example, model No. ZVM4206A, manufactured by Zetex, via microprocessor U1 output RB2 that results in directional control radiation being generated by directional light transmitter 130, designated LD1 in FIG. 18. No current limiting resistor is required for directional light transmitter LD1. Each 70 microseconds, microprocessor U1 checks the status of direction keys 124. If microprocessor U1 ascertains that the same key is still being pressed, it continues to generate the same pulse sequences. If microprocessor U1 ascertains that a different key is being pressed, microprocessor U1 changes the period (i.e., the frequency) of the visible light sequence to that of the new key being pressed. If microprocessor U1 determines that no key is currently being pressed, it enters the quiescent state.

Figure 19:
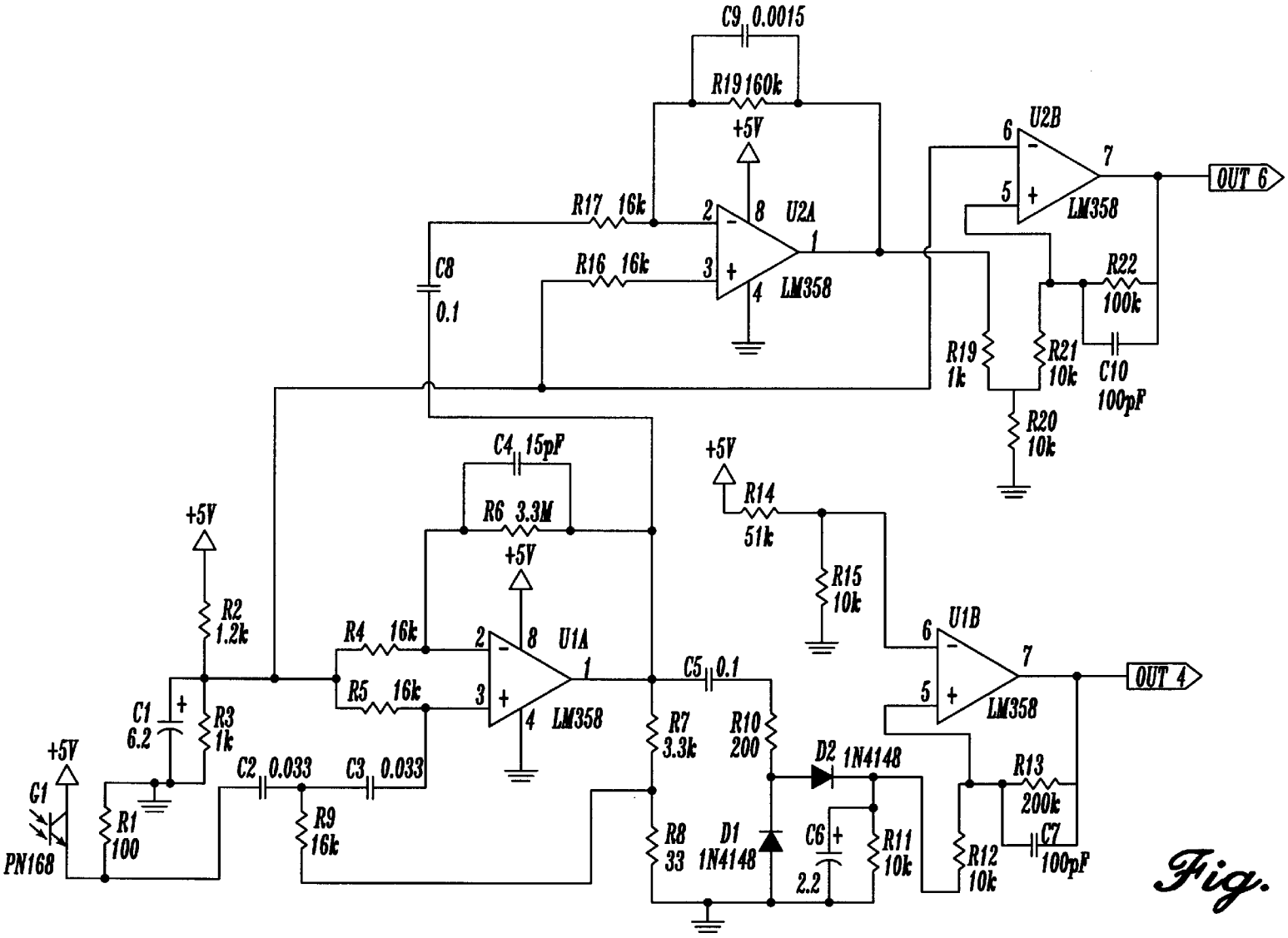
FIG. 19 is an electrical schematic of the circuitry of the directional light detector of the optoelectric remote control apparatus of the present invention.

Next referring to FIG. 19, the electronic circuitry of visible light detectors 160 is described. This circuitry distinguishes the modulated visible directional control radiation of hand unit 120 from interfering background radiation, demodulates it and provides two logic output signals. One output signal (OUT4) is HIGH when any radiation modulated with a frequency of 200 to 500 Hz is detected. The other output reproduces the same frequency by which the detected radiation is modulated. Photo transistor Q1, for example, model No. PN168, manufactured by Panasonic, changes its current proportional to the radiation level, thus creating an additional voltage drop across resistor R1, a 100 Ohm resistor. This voltage is applied to the input of frequency sensitive operational amplifier U1A, for example, model No. LM358, manufactured by National Semiconductor. A voltage divider, consisting of resistor R2, a 1.2k Ohm resistor, and resistor R3, a 1k Ohm resistor, provides a DC bias to operational amplifier U1A. Resistor R6, a 3.3M ohm resistor, and resistor R4, a 16k Ohm resistor, set the DC gain of operational amplifier U1A to approximately 200. Capacitor C2, a 0.01 $\mu$F capacitor, capacitor C3, a 0.01 $\mu$F capacitor, resistor R5, a 60k Ohm resistor, resistor R9, a 16k Ohm resistor, and a voltage divider comprised of resistor R7, a 3.3k Ohm resistor, and resistor R8, a 33 Ohm resistor, compose a Sallen-Key high pass filter with a cutoff frequency around 600 Hz. Capacitor C4, a 15 $\mu$F capacitor, suppresses possible high frequency oscillations. The amplified signal from the output of operational amplifier U1A activates a charge pump that is composed of capacitor C5, a 0.1 $\mu$F capacitor, resistor R10, a 200 Ohm resistor, and diodes D1 and D2, for example, model No. 1N4148, manufactured by National Semiconductor. This charge pump charges capacitor C6, a 1 $\mu$F capacitor, to a voltage proportional to the amplitude of the signal at the charge pump input. Due to resistor R11, a 10k Ohm resistor, charge pump has its own band pass characteristic with the center frequency being around 1000 Hz. Together with the Sallen-Key high pass filter, the charge pump creates the required selectivity of laser detector 116 with a center frequency around 930 Hz. If the voltage across capacitor C6 is large enough, the voltage triggers a Schmitt trigger based on operational amplifier U1B, for example, model No. LM358 manufactured by National Semiconductor. The output of operational amplifier U1B is set HIGH by voltage large enough to trigger the Schmitt trigger. This is an indication that radiation is detected. Resistor R12, a 10k Ohm resistor, and resistor R13, a 10k Ohm resistor, set the hysteresis of the Schmitt trigger, while resistor R14, a 51k Ohm resistor, and resistor R15, a 10k Ohm resistor, set the threshold of the Schmitt trigger. Capacitor C4 suppresses possible false triggering based on short length spikes. The amplified signal is also transmitted from the output of U1A to the additional bandpass amplifier U2A, for example, model No. LM358, manufactured by National Semiconductor. The gain of bandpass amplifier U2A (around 10) is set by resistor R17, a 16k Ohm resistor, and resistor R18, a 160k Ohm resistor. Together with capacitor C8, a 0.1 $\mu$F capacitor and capacitor C9, a 0.0015 $\mu$F capacitor, resistor R17 and R18 set the bandpass between 150 and 800 Hz. The Schmitt trigger based on operational amplifier U2B, for example, model No. LM358, manufactured by National Semiconductor, which is equivalent to the Schmitt trigger U1B described above, translates the amplified signal to the logic level while maintaining its original frequency. The logic signal passes from output OUT6 to microprocessor U1 of FIG. 16 where the frequency of the logic signal is measured and the directional command is decoded.

While the subject invention is shown in the environment of a toy vehicular apparatus with surface and subsurface vehicles and associated surface and subsurface roadways, the subject invention is equally applicable in a system with a single level of vehicles and roadways. Likewise, while an electromagnetic intersection is shown to guide the vehicles, other modes of guidance, i.e., electromechanical, for example, can be employed with the subject invention to control vehicle movement through an intersection. Furthermore, while the remote control apparatus has been described to guide vehicles, it can also be employed to activate and deactivate any actuatable component of a toy environment, such as actuating lights, opening doors, energizing motors for cranes or elevators, and actuating sound devices.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A remote control apparatus for guiding tov vehicles on a roadway comprising:

means for generating a light control signal, the light control signal being coded for providing a user a choice of at least four distinct signals to guide a toy vehicle;

means for receiving a light control signal, the means for receiving a light control signal located on a toy roadway; and means for processing the light control signal generated by said means for generating a light control signal and received by said means for receiving a light control signal to directionally guide the toy vehicle through an intersection of the roadway or electromagnetically stop a toy vehicle.

2. The apparatus of claim 1, wherein a single means for receiving a light control signal receives all signals from said means for generating a light control signal.

3. A remote control apparatus for guiding toy vehicles on a roadway comprising:

means for generating a light wireless vehicle control signal, the light wireless control signal being coded for providing a user a choice of at least four distinct signals to guide a toy vehicle;

means for receiving a light wireless vehicle control signal, the means for receiving a light wireless vehicle control signal located on a toy roadway; and means for processing the light wireless vehicle control signal generated by said means for generating a light wireless vehicle control signal and received by said means for receiving a light wireless vehicle control signal to directionally guide the toy vehicle through an intersection of the roadway or electromagnetically stop a toy vehicle.

4. The apparatus of claim 3, wherein a single means for receiving a light wireless vehicle control signal receives all signals from said means for generating a light wireless vehicle control signal.

5. A remote control apparatus for guiding toy vehicles on a roadway comprising:

means for generating a directionally specific vehicle light control signal, the directionally specific vehicle light control signal being coded for providing a user a choice of at least four distinct signals to guide a toy vehicle;

a single means for receiving all directionally specific vehicle light control signals, the means for receiving all directionally specific vehicle light control signal located on a toy roadway; and means for processing the directionally specific vehicle light control signal generated by said means for generating a directionally specific vehicle light control signal and received by said means for receiving a directionally specific vehicle light control signal to configure the roadway to directionally guide the toy vehicle through an intersection of the roadway or electromagnetically stop a toy vehicle.

6. The apparatus of claim 5, wherein the roadway has a plurality of roads forming intersections and a separate single means for receiving all directionally specific vehicle light control signals is present adjacent each intersection.

7. A remote control apparatus for a plurality of toys having functions controllable by said control apparatus comprising:

means for generating a toy light control signal, the toy light control signal being coded for providing a user a choice of at least four distinct signals to guide a toy vehicle;

means for receiving a toy light control signal, the means for receiving a toy light control signal located on a toy roadway; and means for processing the toy light control signal generated by said means for generating a toy it control signal and received by said means for receiving toy light control signal to directionally control the functions of a plurality of toys through an intersection of the toy roadway.

8. The apparatus of claim 7, wherein a single means for receiving a toy light control signal receives all signals from said means for generating a toy light control signal.

9. A remote control apparatus for guiding toy vehicles on a roadway comprising:

means for generating any one of a plurality of directionally specific vehicle light control signals, the plurality of directionally specific vehicle light control signals being coded for providing a user a choice of at least four distinct signals to guide a toy vehicle;

means for receiving a directionally specific vehicle light control signal, the means for receiving a directionally specific vehicle light control signal located on a toy roadway; and means for processing the directionally specific vehicle light control signals generated by said means for generating a directionally specific vehicle light control signal and received by said means for receiving a directionally specific vehicle light control signal to directionally guide the toy vehicle through an intersection of the toy roadway or electromagnetically stop a toy vehicle.

10. A remote control apparatus for guiding toy vehicles on a roadway comprising:

means for generating any one of a plurality of wireless light vehicle control signals, the plurality of wireless light control signals being coded for providing a user a choice of at least four distinct signals to guide a toy vehicle;

means for receiving a wireless light vehicle control signals, the means for receiving a light control signal located on a toy roadway; and means for processing the wireless light vehicle control signal generated by said means for generating wireless light vehicle control signals and received by said means for receiving a wireless light vehicle control signal to directionally guide the toy vehicle through an intersection of the toy roadway or electromagnetically stop a toy vehicle.

11. A remote control apparatus for guiding toy vehicles on a roadway comprising:

means for generating any one of a plurality of directionally specific vehicle light control signals, the plurality of directionally specific vehicle light control signal being coded for providing a user a choice of at least four distinct signals to guide a toy vehicle;

a single means for receiving all directionally specific vehicle light control signals, the means for receiving all directionally specific vehicle light control signals located on a toy roadway; and means for processing the directionally specific vehicle light control signal generated by said means for generating directionally specific vehicle light control signals and received by said means for receiving a directionally specific vehicle light control signal to directionally configure the toy roadway to guide the toy vehicle through an intersection of the toy roadway or electromagnetically stop the toy vehicle.

12. A remote control apparatus for a plurality of toys having functions controllable by said control apparatus comprising:

means for generating any one of a plurality of location specific toy light control signals, the plurality of location specific toy light control signals being coded for providing a user a choice of at least four distinct signals to guide a toy vehicle;

means for receiving a location specific toy light control signal, the means for receiving a light control signal located on a toy roadway; and means for processing the location specific toy light control signal generated by said means for generating a plurality of location specific toy light control signals and received by said means for receiving a location specific toy light control signal to directionally control the functions of a plurality of toys through an intersection of the roadway or to stop a toy vehicle adjacent an intersection.

13. A remote control apparatus for a plurality of toys having functions controllable by said control apparatus comprising:

means for generating any one of a plurality of light toy control signals, the plurality of light control signals being coded for providing a user a choice of at least four distinct signals to guide a toy vehicle;

means for receiving a light toy control signal, the means for receiving a light control signal located on a toy roadway; and means for processing the light toy control signal generated by said means for generating light toy control signals and received by said means for receiving a light toy control signal to directionally control the functions of a plurality of toys through an intersection of the toy roadway or to stop a toy vehicle adjacent an intersection.

* * * * *

UNITED STATES PATENT AND TRADEMARK OFFICE

CERTIFICATE OF CORRECTION

PATENT NO. : 6,012,957
DATED : January 11, 2000
INVENTOR(S) : P. Cyrus et al.

It is certified that error appears in the above-identified patent and that said Letters Patent is hereby corrected as shown below:

Column 13,
Line 43, "it" should read --light--

Column 14,
Line 12, "signals" should read --signal--

Signed and Sealed this

Third Day of July, 2001

*Attest:*

Nicholas P. Godici

*Attesting Officer*

NICHOLAS P. GODICI
*Acting Director of the United States Patent and Trademark Office*